US009487032B2

(12) United States Patent
Ueno

(10) Patent No.: US 9,487,032 B2
(45) Date of Patent: Nov. 8, 2016

(54) RECORDING APPARATUS

(71) Applicant: SEIKO EPSON CORPORATION, Tokyo (JP)

(72) Inventor: Kohei Ueno, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/057,438

(22) Filed: Mar. 1, 2016

(65) Prior Publication Data

US 2016/0257136 A1 Sep. 8, 2016

(30) Foreign Application Priority Data

Mar. 2, 2015 (JP) ..... 2015-039952
Dec. 10, 2015 (JP) ..... 2015-240853

(51) Int. Cl.
*B41J 11/00* (2006.01)

(52) U.S. Cl.
CPC ..... *B41J 11/007* (2013.01); *B41J 11/0005* (2013.01); *B41J 11/0045* (2013.01)

(58) Field of Classification Search
None
See application file for complete search history.

(56) References Cited

U.S. PATENT DOCUMENTS

2014/0292978 A1* 10/2014 Kodama ..... B41J 11/0005 347/104

FOREIGN PATENT DOCUMENTS

JP 2014-196182 10/2014

* cited by examiner

*Primary Examiner* — Bradley Thies
(74) *Attorney, Agent, or Firm* — Workman Nydegger

(57) ABSTRACT

A recording apparatus is provided that includes a first operating portion which operates for the first regions at both outsides further than the discharging portion in the opening width direction of the discharged paper to be positioned on the lower side (first direction side) further than the pinched position which is pinched by the discharge driving roller and the discharge driven roller, in the recording surface intersecting direction (vertical direction) intersecting with surfaces which become the recording surface, and a second operating portion which operates for the second regions on each outside of the first region in the opening width direction of the discharged paper to be positioned on the upper side (second direction side) further than the first region.

11 Claims, 16 Drawing Sheets

RECORDING APPARATUS

BACKGROUND

1. Technical Field

The present invention relates to a recording apparatus such as an ink jet type printer.

2. Related Art

In the related art, as a type of a recording apparatus, an ink jet type printer is known which includes a recording portion performing recording an image, or the like on paper by ejecting ink as an example of liquid on the paper, which is an example of a medium, and discharges the paper on which recording is finished to a paper discharging tray. In such a printer, a phenomenon in which the paper is curled (curved) by attaching the ink to the paper, which is ejected from the recording portion, may be generated.

That is, since one surface side, which becomes a recording surface of the paper, expands more than the other surface side by attaching the ink to the paper, both end portions of the paper are likely to be curled so as to be warped to the other surface side in the width direction intersecting with the transportation direction of the paper. As a result, the paper on which recording is performed is discharged to the paper discharging tray in a shape of being curled, and thus there is a case in which the paper is not appropriately discharged to the paper discharging tray. Here, in order to correct curling generated in the paper, the recording apparatus including a curving member, which makes the both end portions of the paper in the width direction be curved in one direction of a vertical direction (upward and downward direction), has been proposed (for example, JP-A-2014-196182).

However, in a case in which recording is performed on both surfaces of the paper, warped curling is likely to be generated in the paper from one surface side, in which an amount of liquid ink to be ejected is large, to the other surface side having a small liquid amount of the ink. Therefore, depending on the amount of the liquid ink to be ejected, directions of the curling generated in the paper are respectively different. Accordingly, in a case of the printer disclosed in JP-A-2014-196182, the curling cannot be corrected depending on the direction of the curling generated in the paper.

SUMMARY

An advantage of some aspects of the invention is to provide a recording apparatus which is capable of correcting curling regardless of the direction of the curling generated in a medium.

According to an aspect of the invention, there is provided a recording apparatus including a recording portion that performs recording on a recording surface of a medium, a discharging path that allows the medium, on which recording is performed by the recording portion, to be discharged, a discharging opening portion that is successive to the discharging path, and includes an opening where the medium is discharged in a discharging direction, a discharging portion that is provided at the center portion of the width direction intersecting with the discharging direction in the discharging opening portion, and discharges the medium from the opening by a rotation member which is rotated while pinching the medium, a first operating portion that operates for first regions positioned on both sides of a pinched position which is pinched by the rotation member, of the medium discharged by the discharging portion, in the width direction, to be positioned on a first direction side further than the pinched portion, in a recording surface intersecting direction which is a direction intersecting with the recording surface, and a second operating portion that operates for second regions positioned on both sides of a region which includes the pinched position and the first region, of the medium discharged by the discharging portion, in the width direction, to be positioned on a second direction side opposite to the first direction side further than the first region, in the recording surface intersecting direction.

According to the configuration, the recording apparatus includes a first operating portion that operates for first regions positioned on both sides of a pinched position which is pinched by the rotation member, of the medium discharged by the discharging portion, in the width direction, to be positioned on a first direction side further than the pinched portion, in a recording surface intersecting direction which is a direction intersecting with the recording surface, and a second operating portion that operates for second regions positioned on both sides of a region which includes the pinched position and the first region, of the medium discharged by the discharging portion, in the width direction, to be positioned on a second direction side opposite to the first direction side further than the first region, in the recording surface intersecting direction.

Accordingly, when seen in the discharging direction in which the medium is discharged, a curved shape which protrudes in the first direction in the recording surface intersecting direction on the first region, and a curved shape which protrudes in the second direction opposite to the first direction in the recording surface intersecting direction on the second region, are formed. That is, the medium is discharged from the discharging opening portion, in a state in which the curved shape, which is an undulated wavy shape, is formed throughout in the width direction. For this reason, the curved shape protruding in the first direction or the second direction, which is generated in the medium caused by a recording operation of the recording portion, is suppressed. Therefore, curling can be corrected regardless of the direction of the curling generated in the medium.

In the recording apparatus, it is preferable that the first operating portion is a first contact position, which is in contact with a surface of the second direction side on the first region of the discharged medium, at a position of the first direction side further than the pinched position, in the recording surface intersecting direction, and the second operating portion is a second contact portion, which is in contact with a surface of the first direction side in the second region of the discharged medium, at a position of the second direction side further than the position with which the first contact portion is in contact, in the recording surface intersecting direction.

According to the configuration, the first contact portion operates for the first region of the discharged medium to be positioned on the first direction side further than the pinched position, and the second contact portion operates for the second region of the discharged medium to be positioned on the second direction side further than the first region. Accordingly, when seen in the discharging direction in which the medium is discharged, the curved shape which protrudes to the first direction in the recording surface intersecting direction on the first region, and the curved shape which protrudes in the second direction opposite to the first direction in the recording surface intersecting direction on the second region, are formed. That is, the medium is discharged from the discharging opening portion, in a state in which the curved shape, which is an undulated wavy shape, is formed throughout in the width direction.

In the recording apparatus, it is preferable that the first contact portion and the second contact portion are provided at positions overlapping each other in the discharging direction in which the medium is discharged.

According to the configuration, in the discharging direction in which the medium is discharged, the first contact portion and the second contact portion can be provided in a relatively small space, and thus an increase in the size of the apparatus can be suppressed.

In the recording apparatus, it is preferable that the first contact portion and the second contact portion are provided at positions different from each other in the discharging direction in which the medium is discharged.

According to the configuration, at the time of discharging the medium, the first contact portion and the second contact portion are in contact with the medium at respectively different timings. Therefore, at the time of suppressing curving generated in the medium, a discharging defect of the medium can be suppressed by contacting the medium with the first contact portion and the second contact portion.

In the recording apparatus, it is preferable that, in the contact position with the medium in the second contact portion, the position in the recording surface intersecting direction is capable of being displaced.

According to the configuration, since the contact position in contact with the medium in the second contact portion can be displaced, a degree of strongness of contacting of the second contact portion with respect to the medium can be changed.

In the recording apparatus, it is preferable that the second contact portion is provided to be movable in the width direction.

According to the configuration, in the width direction of the discharging opening portion, the second contact portion is capable of displacing a position with which the medium is in contact, and makes the medium be positioned on the contact position according to types of the medium.

In the recording apparatus, it is preferable that in at least one of the first contact portion and the second contact portion, the contact position which is in contact with the medium at the time of being in contact with the medium, is capable of being displaced to the downstream side in the discharging direction in which the medium is discharged.

According to the configuration, when curving of the medium is suppressed by being in contact with the first contact portion and the second contact portion, at least one of the first contact portion and the second contact portion is not excessively strongly in contact with the medium. Therefore, at the time of suppressing curving generated in the medium, a discharging defect of the medium can be suppressed by contacting the medium with the first contact portion and the second contact portion.

In the recording apparatus, it is preferable that the first operating portion is a first air blowing portion which blows the air to a surface in the first region of the discharged medium.

According to the configuration, the first operating portion is not in contact with the medium, and thus the image formed on the medium is not damaged. When seen in the discharging direction in which the medium is discharged, the curved shape protruding in the first direction in the recording surface intersecting direction on the first region is formed.

In the recording apparatus, it is preferable that the second operating portion is a second air blowing portion which blows the air to a surface in the second region of the discharged medium.

According to the configuration, the second operating portion is not in contact with the medium, and thus the image formed on the medium is not damaged. When seen from the discharging direction in which the medium is discharged, the curved shape protruding in the second direction in the recording surface intersecting direction on the second region is formed.

In the recording apparatus, it is preferable that the discharging portion is provided on the downstream side further than the first contact portion and the second contact portion, in the discharging direction.

According to the configuration, when a front edge portion of the discharging direction of the medium transported to the downstream side of the discharging direction is in contact with the first contact portion and the second contact portion, the front edge portion of the medium is at a position on the upstream side further than the discharging portion, and is not affected by the influence of the transporting force generated by the discharging portion. Accordingly, jamming of the medium, when the front edge portion of the medium is deformed with respect to the width direction, is suppressed.

In the recording apparatus, it is preferable that the discharging portion is provided at the upper stream side further than the first contact portion and the second contact portion, in the discharging direction.

According to the configuration, the discharging portion can be provided at the internal side of the case, and thus contact of a user's hand with the discharging portion can be suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, as an embodiment of a recording apparatus, an ink jet type printer which performs printing (recording) of an image including characters, figures, and the like, on paper, which is an example of medium, by ejecting ink, which is an example of liquid, thereto will be described with reference to drawings.

Embodiment 1

Figure 1:
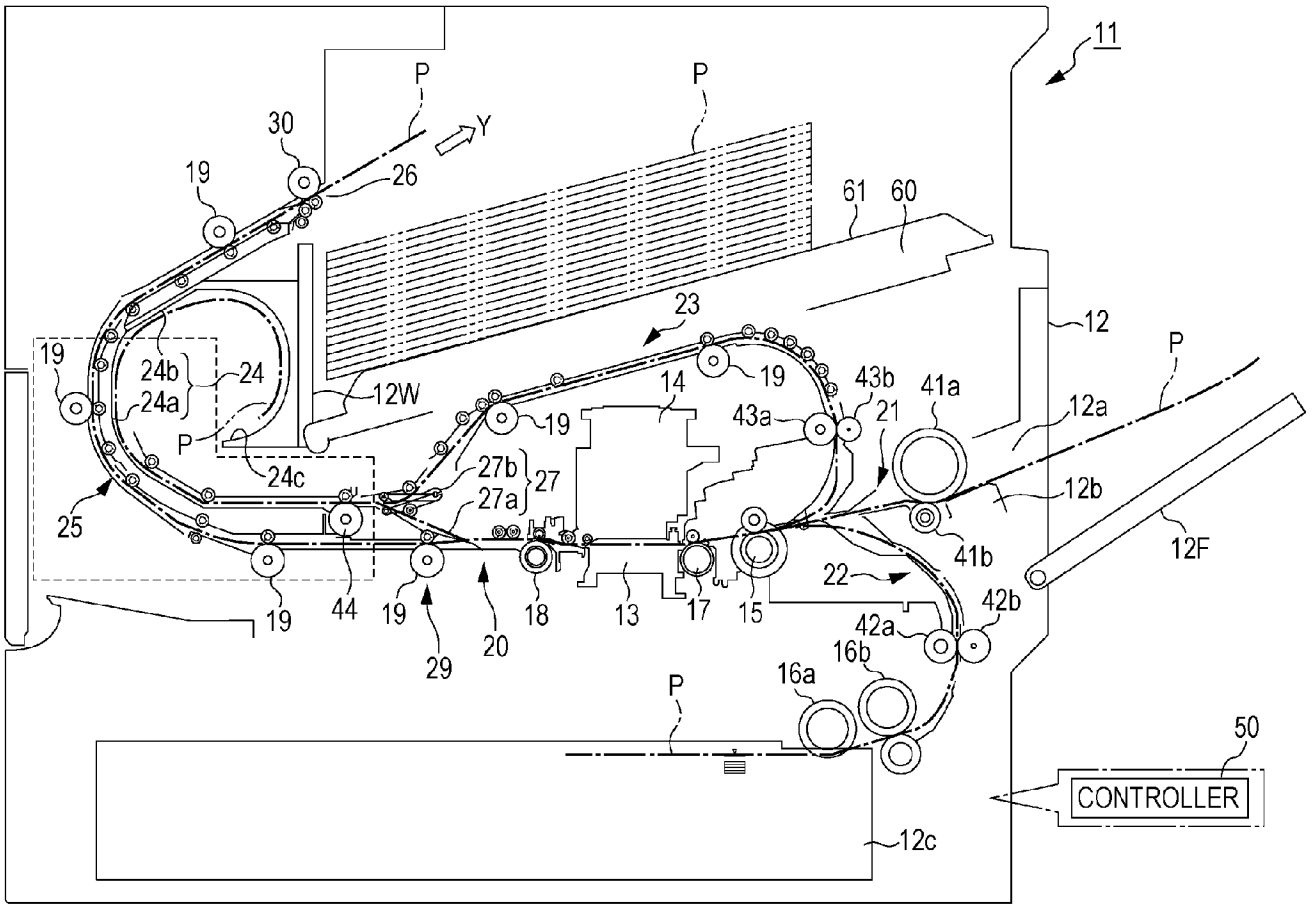
FIG. 1 is a schematic structural view illustrating an embodiment of a printer which is an example of a recording apparatus.

As illustrated in FIG. 1, a printer 11 includes a supporting base 13 that supports paper P, which is an example of a medium, from below in a vertical direction (upward and downward direction), a recording portion 14 that records an image onto the paper P, and a transportation path 20 through which the paper P is transported in a substantial rectangular case 12. In addition, a transportation portion 29 which is configured to have a plurality of rollers (a pair of rollers) and transports the paper P along the transportation path 20 is also included therein.

When a frontward and rearward direction of paper in FIG. 1 is set to a width direction of the paper P, the printer 11 transports the paper P in a direction which is a transportation direction intersecting with the width direction, on the supporting base 13 along the transportation path 20. The recording portion 14 includes a line head as a liquid ejecting head which is capable of simultaneously ejecting ink throughout substantially the entirety in the width direction intersecting with the transportation direction of the paper P, and prints an image by ejecting the ink onto the paper P, which is transported on the supporting base 13, from an upper side in the vertical direction.

The printed paper P is transported to a discharging path 25 which constitutes a downstream part of the transportation path 20 from the recording portion 14 by a pair of discharging rollers 18 or the other multiple pairs of transportation rollers 19, and is discharged to the outside of the discharging path 25 from a discharging port 26 which is provided at an end of the discharging path 25 and opened to the case 12. Therefore, the paper P is set in a moving direction in which the transportation direction to the discharging port 26 and the discharging direction Y from the discharging port 26 are the same as each other. Also, the paper P, which is discharged in the discharging direction Y illustrated by an empty arrow in FIG. 1 from the discharging port 26, is dropped to a lower side of the vertical direction, and is discharged to a mounting surface 61 of a paper discharging tray (mounting portion) 60 in a state in which the paper is stacked up to a predetermined maximum number as illustrated by a two-dot chain line in FIG. 1. Moreover, by the pair of transportation rollers 19 disposed at a plurality of parts of the discharging path 25, the paper P is discharged to a paper discharging tray 60 in a posture in which the recording surface (a surface where an image is printed) of the paper faces the bottom in the vertical direction from the discharging port 26.

The paper discharging tray 60 includes the mounting surface 61 which is a surface inclined upward to a upper side in the vertical direction toward the discharging direction Y of the paper P, and is mounted on the mounting surface 61 in a state in which the paper P is stacked. At this time, each paper P mounted on the mounting surface 61 is moved in a direction opposite to the discharging direction Y along an inclination of the mounting surface 61, and is mounted to approach a vertical side wall 12W which is provided on a lower side of the discharging port 26 of the case 12.

In the embodiment, the transportation path 20 includes the discharging path 25 through which the paper P is transported from the recording portion 14 to the discharging port 26 and a supplying path through which the paper P is supplied to the recording portion 14. The supplying path is configured to have a first supplying path 21, a second supplying path 22, and a third supplying path 23.

During transporting the paper P printed by the recording portion 14 to the discharging port 26, the discharging path 25 includes a curving and reversing path which makes the recording surface of the paper P printed by the recording portion 14 curve inward, and reverses the paper P from a state in which the recording surface of the paper P is curved upward in the vertical direction to a state in which the recording surface of the paper P is curved downward in the vertical direction. Therefore, in the discharging path 25, the recording surface of the paper P faces the mounting surface 61 of the paper discharging tray 60 by passing the curving and reversing path so as to be discharged from the discharging port 26.

In the first supplying path 21, the paper P, which is inserted from an inserting port 12*a* exposed by opening a cover 12F provided in one side surface of the case 12, is transported to the recording portion 14. That is, the paper P inserted to the inserting port 12*a* is pressed by a first driving roller 41*a* using a hopper 12*b* and is transported by rotatedly driving the first driving roller 41*a* so as to be pinched between the first driving roller 41*a* and a first driven roller 41*b*, and then the paper is transported toward the recording portion 14 by rotatedly driving the first driving roller 41*a*.

In the second supplying path 22, in the vertical direction, the paper P, which is mounted to be capable of being stacked in a paper cassette 12*c* provided to be inserted into a bottom portion (a lower side) of the case 12, is transported to the recording portion 14. That is, the paper P mounted to be capable of being stacked in the paper cassette 12*c* is pinched between a second driving roller 42*a* and a second driven roller 42*b* and is transported toward the recording portion 14 by rotatedly driving the second driving roller 42*a*, after the uppermost paper P is sent by a pick-up roller 16*a* and separated one by one using a pair of separating rollers 16*b*.

In the third supplying path 23, when double-surface printing is performed in which printing is performed on both surfaces of the paper P, the paper P in which one surface thereof is printed by the recording portion 14 is transported to the recording portion 14 again. That is, a branch path 24 branched from the discharging path 25 is provided in the downstream side of the transportation direction of the paper P closer than the recording portion 14, by an operation of a branching mechanism 27, which is provided in the middle of the discharging path 25.

When seen in the width direction of the paper P orthogonal (intersecting) to the transportation direction of the paper P, the branch path 24 is provided at a position which is an opposite side (left side in FIG. 1) of the paper discharging tray 60 with respect to the discharging port 26, and a length thereof is provided to be equal to or greater than a medium length of the paper P in the transportation direction. In addition, the branch path 24 is configured to have an upper stream side branch path (first path portion) 24*a* and a downstream side branch path (second path portion) 24*b* connected thereto. The upper stream side branch path 24*a* extends from the branching mechanism 27, which is an upper stream side part that becomes a beginning end side of the branch path 24, along the discharging path 25. The downstream side branch path 24*b* extends so as to be apart from the discharging port 26, which is a downstream side part that becomes a final end side of the branch path 24 and is the end of the discharging path 25. That is, the branch path 24 includes a curving path where the paper P is curved in a posture in which the recording surface thereof becomes an inner side. In addition, the downstream side branch path 24*b* includes a guiding surface 24*c* which guides the paper P by coming into contact with a rear surface side opposite to the recording surface in the paper P on which recording is performed by the recording portion 14.

In the branch path 24, a pair of branch path rollers 44, which is rotatable in a both ways of normal rotation and reverse rotation, is provided at the downstream side of the branching mechanism 27. Moreover, the branching mechanism 27 is configured to have a first flap 27*a* and a second flap 27*b* as switching portions which selectively switch transportation paths of the paper P.

At the time of double-surface printing, first, the paper P in which one surface is printed is guided to the branch path 24 from the recording portion 14 side by the first flap 27*a* side of the branching mechanism 27, and is transported to the downstream side in the branch path 24 by the pair of branch path rollers 44 which is rotated normally. At this time, the paper P transported to the branch path 24 is curved so that the recording surface thereof becomes an inner side along the branch path 24.

After that, the paper P which is transported to the branch path 24 is reversely transported in the branch path 24 from the downstream side to the upper stream side by the pair of branch path rollers 44 which is rotated reversely. That is, a transportation direction of the paper P which is transported in the branch path 24 is reversed.

The paper P which is reversely transported from the branch path 24 is transported to the third supplying path 23 by the second flap 27*b* of the branching mechanism 27, and is transported toward the recording portion 14 by a plurality of the pairs of transportation rollers 19. When the paper is transported along the third supplying path 23, the paper P is reversed so that a surface of the paper on which printing is not performed faces the recording portion 14, and is pinched between a third driving roller 43*a* and a third driven roller 43*b*. Then, the paper is transported toward the recording portion 14 by rotatedly driving the third driving roller 43*a*. That is, the third supplying path 23 functions as a reversing path where the front and back surfaces of the paper P are reversed, and the paper is transported again to the recording portion 14.

The first flap 27*a* included in the branching mechanism 27 is capable of switching two positions of a first position for guiding the paper P, in which recording is performed by the recording portion 14, to the curving and reversing path included in the discharging path 25 and a second position for guiding the paper to the branch path 24. In addition, the second flap 27*b* is provided to be capable of switching the two positions of the first position for guiding the paper P, in which recording is performed by the recording portion 14 to the branch path 24 and the second position for guiding the paper from the branch path 24 to the third supplying path 23.

The paper P being transported when each of the supplying paths is toward the recording portion 14, is transported to a pair of aligning rollers 15 which is arranged at the upper stream side of the transportation direction of the recording portion 14, and a front edge thereof is abutted to the pair of aligning rollers 15 which is stopped from being rotated. Also, an inclination of the paper P with respect to the transportation direction is corrected (skewed) in a state of being abutted to the pair of aligning rollers 15. In addition, the paper P in which the inclination is corrected is aligned by rotatedly driving the pair of aligning rollers 15 later, and is transported to the recording portion 14 side.

The paper P, which is transported to the recording portion 14 side by the pair of aligning rollers 15, is transported so as to face the recording portion 14 by a pair of paper feeding rollers 17 provided at the upper stream side of the transportation direction of the paper P with respect to the recording portion 14, the pair of discharging rollers 18 provided the downstream side of the transportation direction, the pair of transportation rollers 19, and the like. Printing is performed by ejecting ink to the transported paper P from the recording portion 14 facing the paper. Moreover, dashed lines expressing the paper P illustrated in FIG. 1 indicate a trajectory of the transported paper P.

In the printer 11, a controller 50 having a function of a computer and a storage (not illustrated) which stores a program for controlling such a printing operation is included. Also, an operation of the recording portion 14 or the transportation portion 29 is controlled based on printing data input to the printer 11 by operating the controller 50 according to the program stored in the storage, and thus the image is printed (recorded) on a printing region as a recording region of the paper P.

Figure 2:
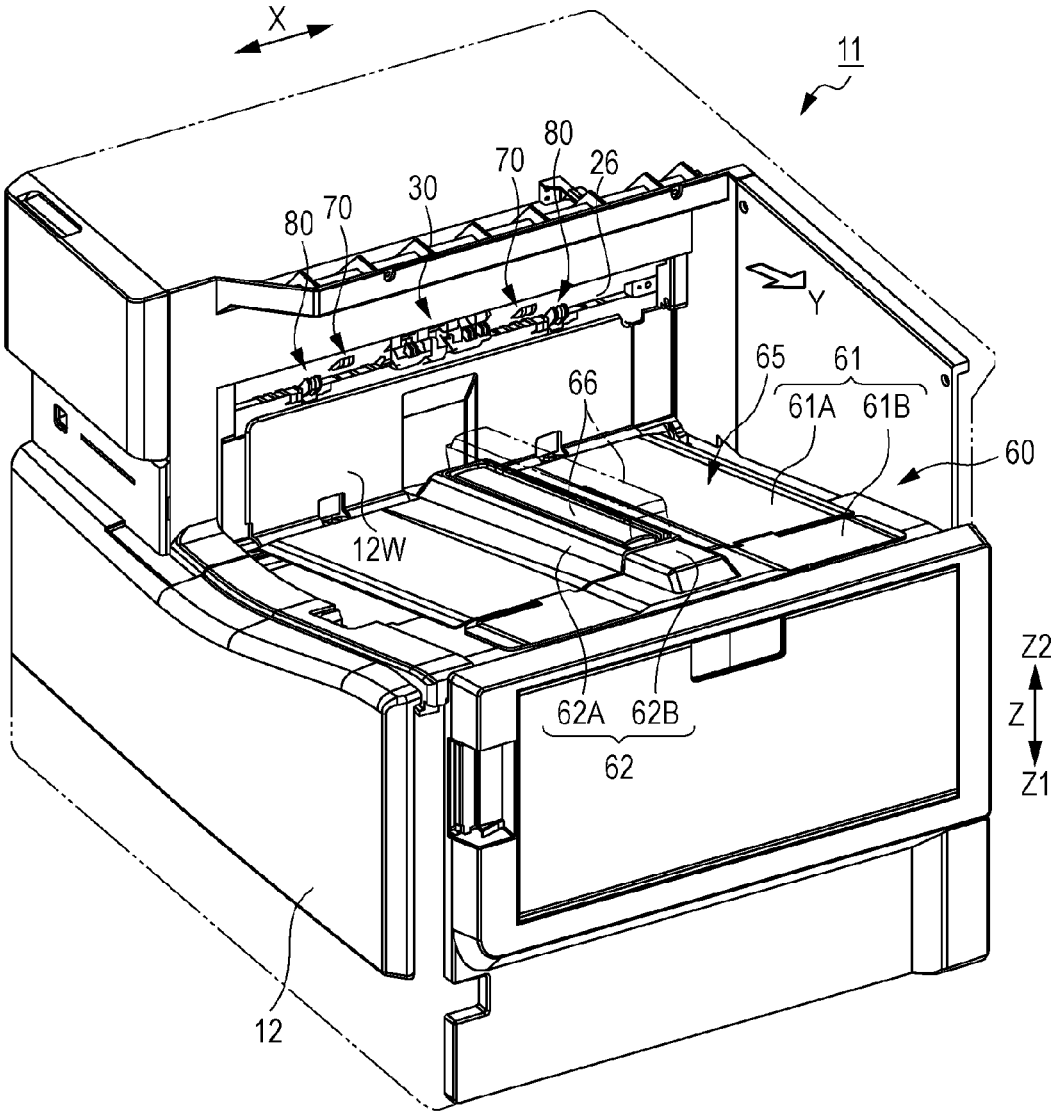
FIG. 2 is an exterior perspective view of the printer in which a part of a case structure is omitted.

As illustrated in FIG. 2, the discharging port 26 is open to the case 12 in an oblong rectangle shape when a direction intersecting with both the discharging direction Y and the vertical direction Z of the paper P is set to an opening width direction X (hereinafter, the opening width direction X is also simply referred to as a width direction X). In the paper discharging tray 60 in which the paper P discharged from the discharging port 26 is mounted, a protrusion rib 66 as a supporting portion capable of protruding upward from the mounting surface 61 which is an upper side surface thereof is provided. That is, the protrusion rib 66 is provided to be movable in a vertical direction, and a displacement mechanism, which is operated when the protrusion rib 66 protrudes at a predetermined rib height (height position) from the mounting surface 61, is provided in the paper discharging tray 60. Moreover, the displacement mechanism is controlled by the controller of the printer 11.

In addition, the mounting surface 61 of the paper discharging tray 60 of the embodiment is constituted by a first mounting surface 61A of the upper stream side and a second mounting surface 61B of the downstream side in the discharging direction Y of the paper P. In the first mounting surface 61A and the second mounting surface 61B, a first convex portion 62A and a second convex portion 62B are respectively provided. The first convex portion 62A and the second convex portion 62B have predetermined widths at a center portion in the width direction X intersecting with the discharging direction Y of the paper P discharged from the discharging port 26, and have predetermined sizes of height of an upper side Z2 in a vertical direction while extending in a direction along the discharging direction Y of the paper P set as a length direction. The first convex portion 62A and the second convex portion 62B overlap with each other when seen in the length direction so as to be one convex portion 62 which are connected along the discharging direction Y in the mounting surface 61.

In the embodiment, the first mounting surface 61A becomes an upper surface of the vertical direction upper side Z2 of a paper discharging tray unit 65 detachable from the printer 11, and the displacement mechanism is provided in the paper discharging tray unit 65. As illustrated by a two-dot chain line in FIG. 2, the protrusion rib 66 protrudes upward at a predetermined rib height from an upper surface of the first convex portion 62A provided on the first mounting surface 61A by operating of the displacement mechanism.

Figure 3:
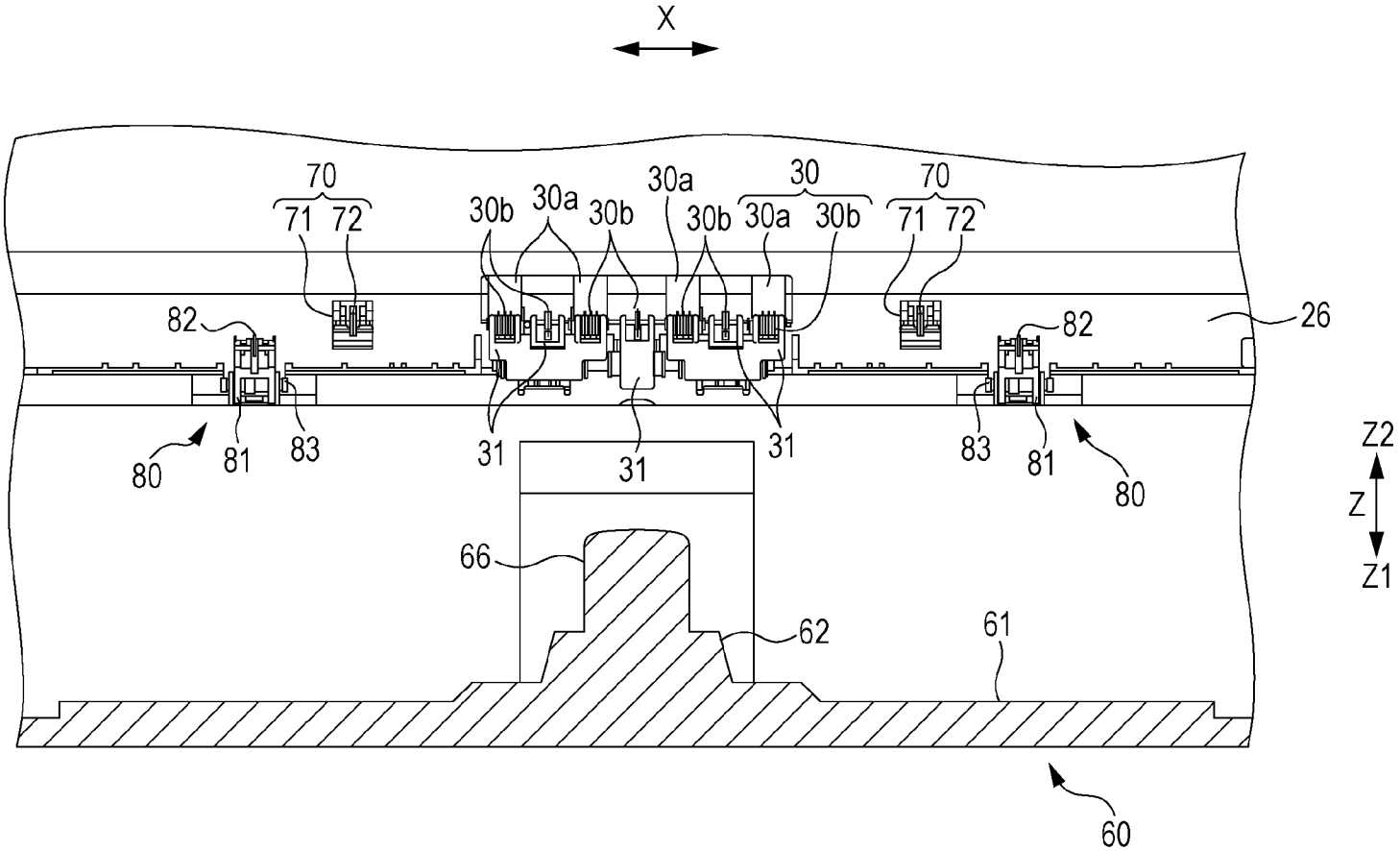
FIG. 3 is a front view illustrating a discharging port.

As illustrated in FIG. 3, in the printer 11, a discharging portion 30 (refer to FIG. 2), which discharges the paper P from the discharging port 26 to the paper discharging tray 60 by coming into contact with the center portion of the width direction X of the paper P discharged from the discharging port 26, is provided at the center portion in the width direction X of the discharging port 26 connected to a dead end of the discharging path 25 through which the paper P is discharged. The discharging portion 30 is constituted by a discharge driving roller 30*a* as a driving roller which is in contact with the paper P from the vertical direction upper side Z2, and a discharge driven roller 30*b* (third contact portion) as a driven roller, which is held in a state of being rotatable by a holding member 31 and is in contact with the paper P from the vertical direction lower side Z1. Multiple discharge driven rollers 30*b* held by the discharge driving rollers 30*a* and the holding member 31 are provided throughout in the width direction X in the center portion of the discharging port 26.

There are the plurality of discharge driven rollers 30*b* provided in the discharging port 26 which face and do not face the discharge driving roller 30*a*. In the embodiment, the discharge driven rollers 30*b* which do not face the discharge driving rollers 30*a* are provided between the discharge driven rollers 30*b* facing the discharge driving rollers 30*a* in the width direction X. In addition, the discharge driven rollers 30*b* not facing the discharge driving rollers 30*a* are provided at a slightly higher position in the vertical direction Z compared to a case of facing the discharge driving rollers 30*a*. Moreover, the discharge driven roller 30*b* is constituted by serrated rollers such as a star wheel in order to reduce a concern of contamination of the recording surface of the paper P recorded by the recording portion 14.

That is, in a state in which the center portion in the width direction X of the paper P is inserted between the discharge driving rollers 30*a* and the discharge driven rollers 30*b* facing the discharge driving rollers, when the discharge driving roller 30*a* drives to be rotated and the discharge driven roller 30*b* is driven to be rotated according to the rotated driving of the discharge driving roller 30*a*, the paper P is discharged to the paper discharging tray 60. At this time, in the discharge driven roller 30*b*, a part with which the paper P is in contact becomes a third medium contact portion 32 (refer to FIG. 9).

In addition, in the discharging port 26 of FIG. 3, each of first contact portions 70, which forms a curved shape protruding along the vertical lower side Z1 (refer to FIG. 2) with respect to the paper P discharged from the discharging port 26, is provided in each of positions which are the outside in the width direction X rather than a position where the discharging portion 30 is provided. The first contact portion 70 is constituted by a protrusion portion 71 which protrudes from the discharging port 26 in the vertical lower side Z1, and a roller 72 supported to be rotatable by the protrusion portion 71. The roller 72 is a roller such as a star wheel, the same as that of the discharge driven roller 30*b*.

That is, when the paper P is discharged from the discharging port 26, each of the first contact portions 70 forms a curved shape in which the paper P is pressed in the vertical lower side Z1 to protrude in the vertical lower side Z1 by contacting the paper P from the vertical direction upper side Z2, at a position which is the outside further than the center portion in the width direction X. Here, in the first contact portion 70, a part, which comes into contact with the paper P, for forming the curved shape to the paper P becomes the first medium contact portion 73 (refer to FIG. 9). The first medium contact portion 73 is a lower end part in the vertical direction Z of the roller 72, and is a position lower than the third medium contact portion 32.

Further, in the discharging port 26 of FIG. 3, second contact portions 80 (refer to FIG. 2) which form the curved shape protruding to a vertical upper side Z2 with respect to the paper P discharged from the discharging port 26, are respectively provided at each of positions which are the outside in the width direction X rather than a position where the first contact portion 70 is provided. The second contact portion 80 is constituted by a holder 81 provided in the discharging port 26 and a roller 82 supported to be rotatable by the holder 81. The roller 82 is constituted by a roller such as the star wheel in the same as that of the roller 72 which constitutes the discharge driven roller 30*b* or the first contact portion 70.

That is, when the paper P is discharged from the discharging port 26, the second contact portion 80 forms each of the curved shapes which protrudes in the vertical direction upper side Z2 by coming into contact with the paper P from the vertical direction lower side Z1 and pressing the paper P at each of positions which is a both end portion of the paper P in the width direction X. Here, in the second contact portion 80, a part, which is in contact with the paper P in order to form the curved shape on the paper P, becomes a second medium contact portion 84 (refer to FIG. 9). The second medium contact portion 84 is an upper end part in the vertical direction Z of the roller 82 and is at a position lower than the third medium contact portion 32 and higher than the first medium contact portion 73.

That is, a contact position, in which the second contact portion 80 which comes into contact with the paper P, is on an upper side in a up and down direction further than a position where the first contact portion 70 is in contact with the paper P. In addition, the contact position in which the first contact portion 70 is in contact with the paper P and the contact position in which the second contact portion 80 is in contact with the paper P are on lower sides in the up and down direction further than the contact position in which the discharge driven roller 30*b* is in contact with the paper P as the third contact portion.

Figure 4:
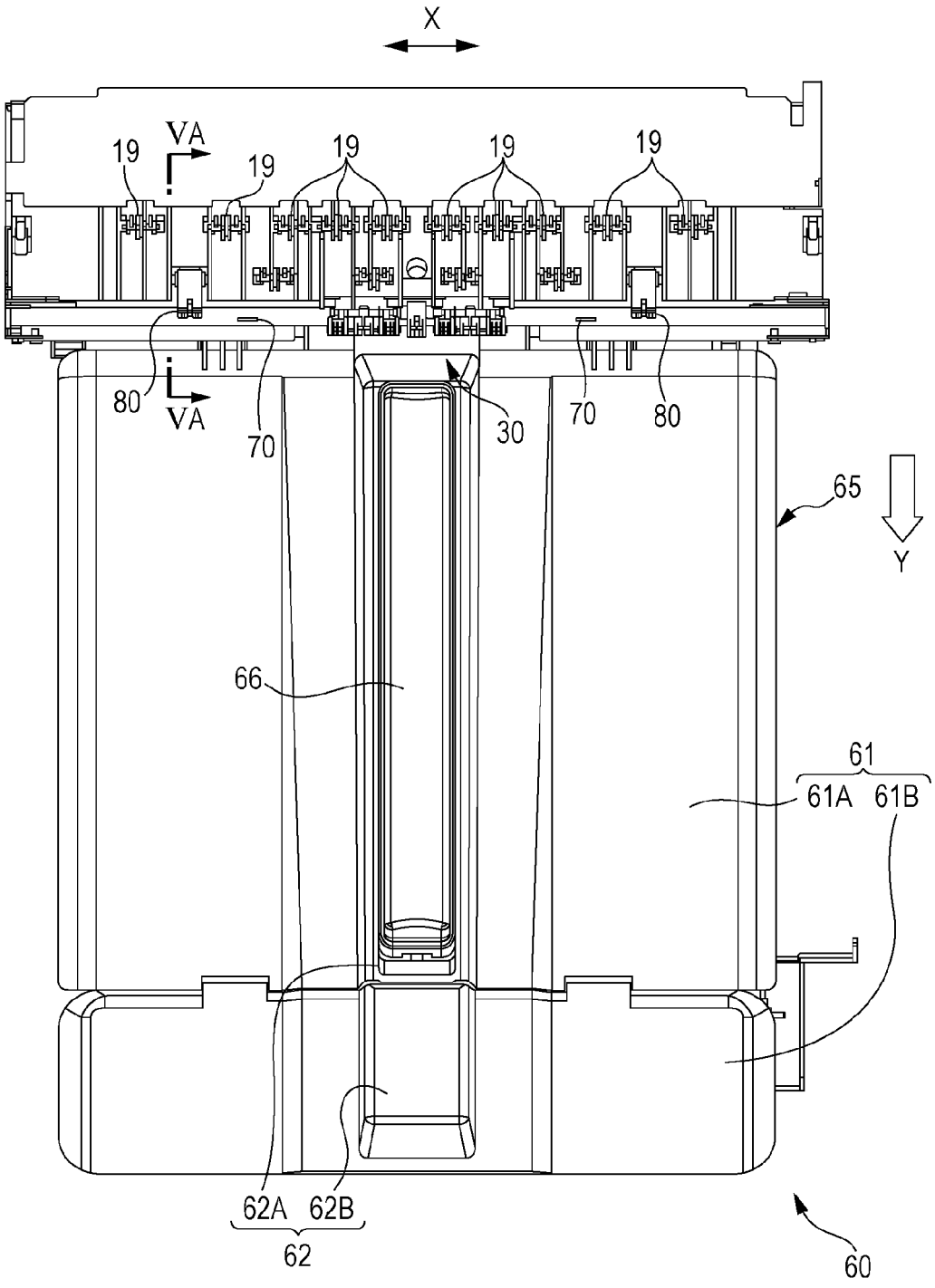
FIG. 4 is a plan view illustrating an internal structure and a discharging tray of a part of the discharging port.

As illustrated in FIG. 4, the discharging portion 30 provided in the discharging port 26, the first contact portion 70, and the second contact portion 80 are provided to be respective in different positions in the discharging direction Y. Specifically, from the upper stream side, the second contact portion 80, the first contact portion 70, and the discharging portion 30 are sequentially provided. That is, when the paper P is discharged from the discharging port 26, after the curved shape of the vertical upper side Z2 is formed by the second contact portion 80, the curved shape of the vertical lower side Z1 is formed by the first contact portion 70.

Figure 5A:
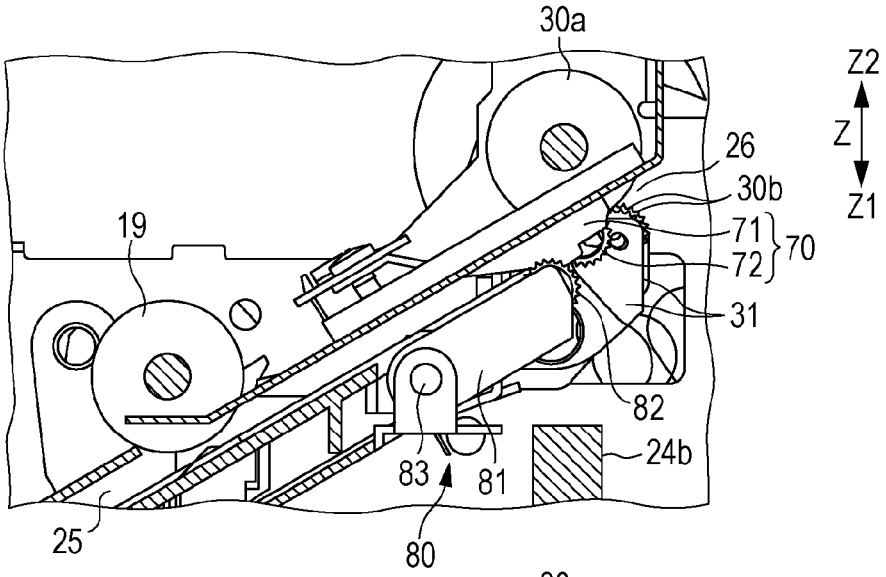
FIG. 5A is a sectional view taken along an arrow of VA-VA in FIG. 4.

As illustrated in FIG. 5A, the holder 81 constituting the second contact portion 80 is supported to be rotatable with respect to the discharging port 26, when a base end which is the upper stream side the discharging direction Y is inserted to a shaft 83 extending in the width direction X. In addition, the roller 82 is supported to be rotatable at the front edge which is an opposite side of the base end.

Figure 5B:
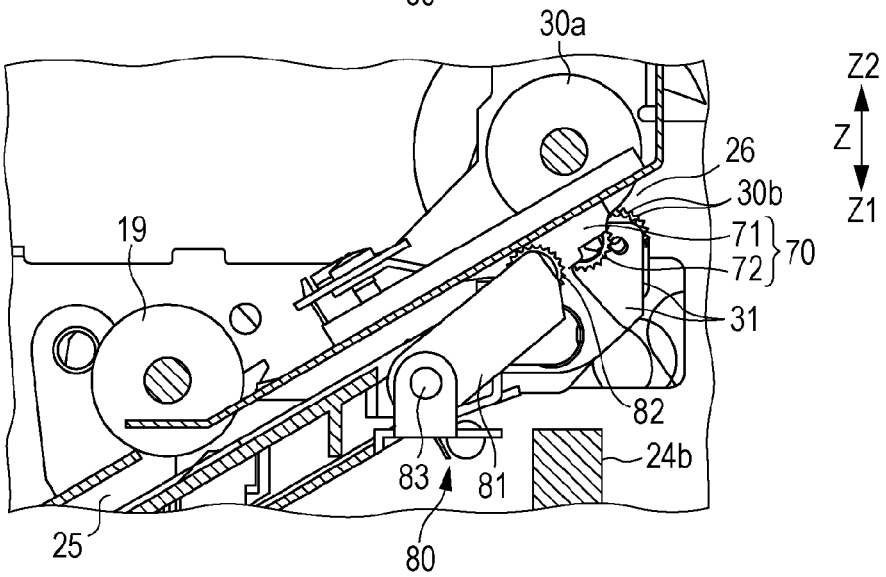
FIG. 5B is a view at the time of rotating a second contact portion in a counterclockwise direction in a state illustrated in FIG. 5A.
Figure 5C:
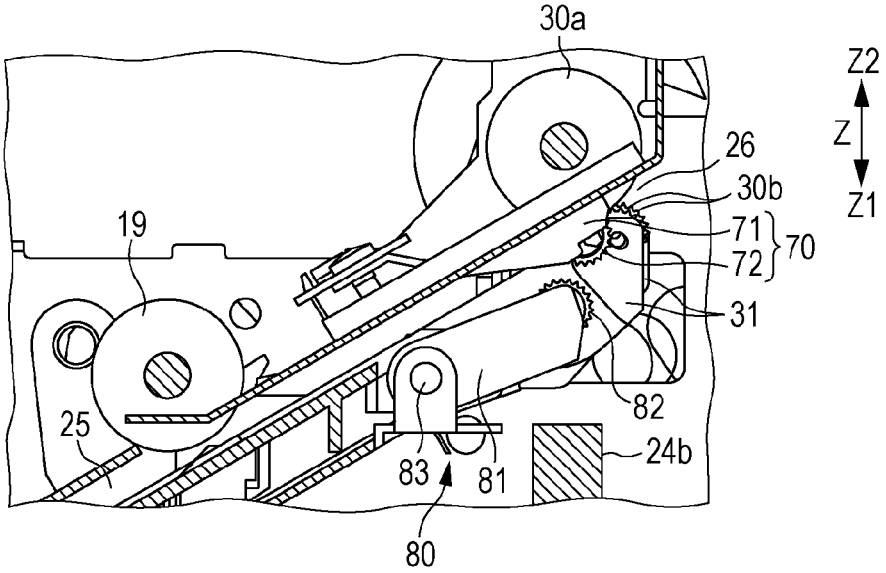
FIG. 5C is a view at the time of rotating the second contact portion in a clockwise direction in the state illustrated in FIG. 5A.

Here, when the holder 81 is rotated in a counterclockwise direction at the shaft 83 as a center, as illustrated in FIG. 5B, a position of the front edge in the holder 81 is displaced, and a position in the vertical direction Z of the roller 82 supported at the front edge side becomes higher. In addition, contrarily, when the holder 81 is rotated in a clock direction at the shaft 83 as a center, as illustrated in FIG. 5C, a position in the vertical direction Z of the roller 82 becomes lower. That is, by rotating the holder 81, the contact position of the paper P of the second medium contact portion 84 included in the second contact portion 80 is displaced in the vertical direction Z. Incidentally, a rotating operation of the holder 81 may be performed by a user manually, or may be performed by controlling of the controller 50.

Next, in the printer 11 configured as described above, an action when performing double-surface printing on the paper P by an operation of the branching mechanism 27 will be described.

As illustrated in FIG. 1, the paper P supplied from the inserting port 12*a* or the paper cassette 12*c* is transported through the first supplying path 21 or the second supplying path 22, and recording is performed on one surface of the paper (recording surface) facing the recording portion 14 by the recording portion 14. Here, when double-surface printing, in which recording is performed additionally on the other surface (rear surface) opposite to the one surface, is performed on in the paper P, the paper P is transported through the third supplying path 23 (reversing path).

Figure 6A:
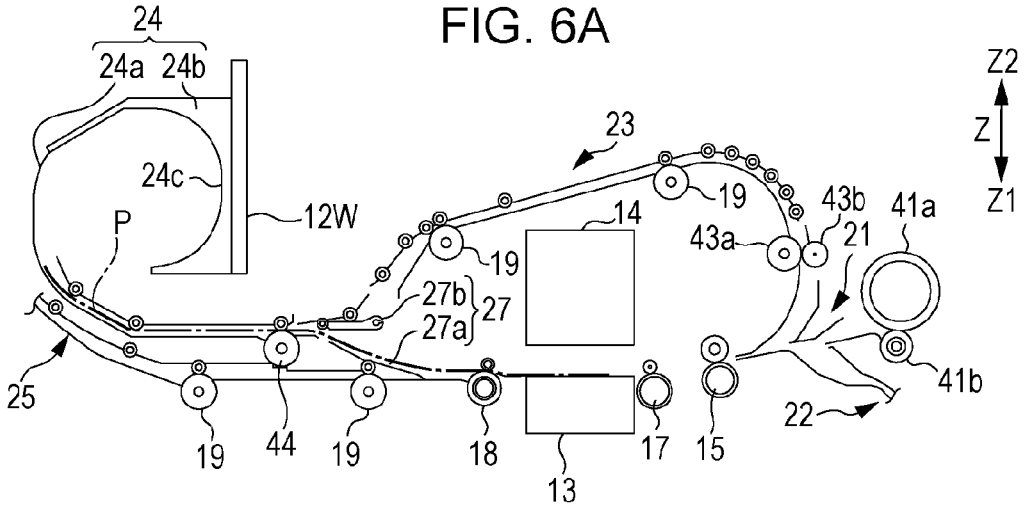
FIG. 6A is a schematic view illustrating a movement of paper at the time of double-surface printing, and a view at the time of transporting the paper along a branch path.

As illustrated in FIG. 6A, the controller 50 controls an operation of the first flap 27*a* and the second flap 27*b* included in the branching mechanism 27, and the first flap 27*a* is positioned on the second position and the second flap 27*b* is positioned on the first position. The paper P is guided to the branch path 24 which is branched from the discharging path 25 by the branching mechanism 27 in which a position each of the flaps 27*a* and 27*b* is switched. The paper P guided to the branch path 24 is a paper which is guided by the guiding surface 24*c* included in the downstream side branch path 24*b* from a rear surface side opposite to the recording surface recorded by the recording portion 14, and is transported to the downstream side through the branch path 24 in a posture in which the recording surface is curved inside.

Figure 6B:
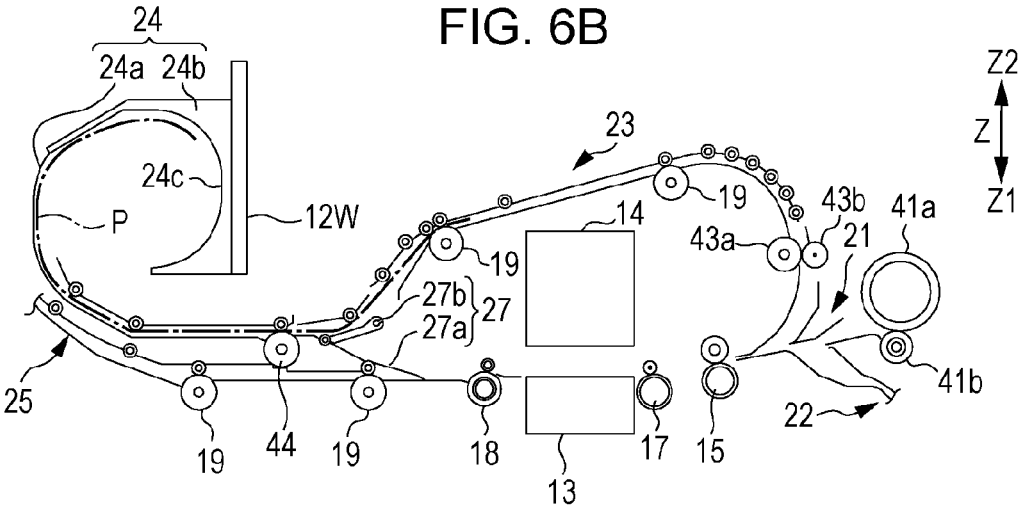
FIG. 6B is a schematic view illustrating the movement of the paper at the time of double-surface printing, and a view at the time of transporting the paper to a third supplying path from the branch path.

As illustrated in FIG. 6B, when the controller 50 determines that the rear end of the paper P passes through the second flap 27*b*, the controller 50 controls an operation of the second flap 27*b* and positions the second flap 27*b* at the second position, and thus the branch path 24 and the third supplying path 23 are connected to each other. Further, when the pair of branch path rollers 44 is driven to be reversely rotated, a transportation direction of the paper P accommodated in the branch path 24 is reversed and the paper is guided to the third supplying path 23.

A posture of the paper P transported through the third supplying path 23 in the vertical direction Z is reversed, and the paper is transported to the recording portion 14 again. At this time, the other surface, which is opposite to the one surface where recording is performed in advance, faces the recording portion 14. That is, by transporting the paper to the third supplying path 23 which functions as the branch path 24 and the reversing path, the paper P has a reversed posture thereof and is transported to the recording portion 14 again.

Figure 6C:
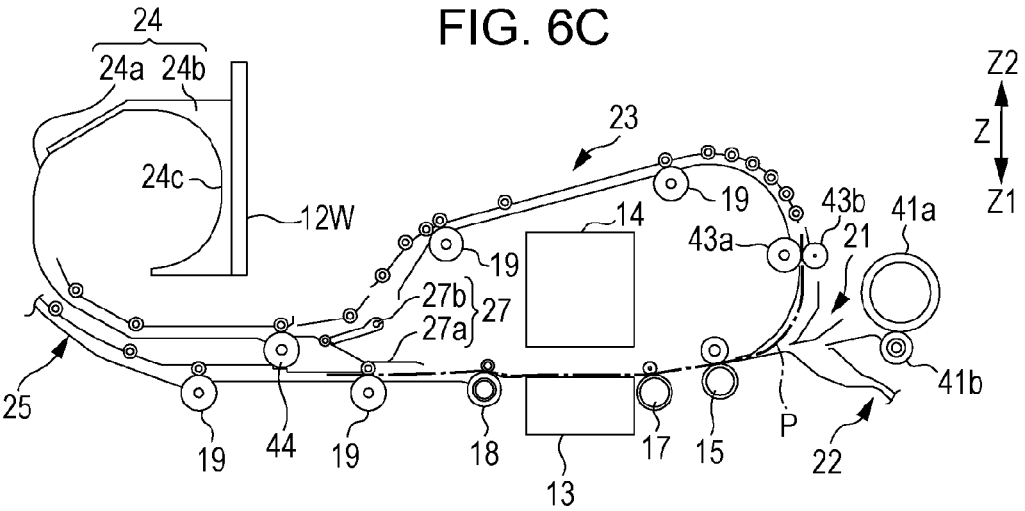
FIG. 6C is a schematic view illustrating the movement of the paper at the time of double-surface printing, and a view at the time of transporting the paper along a discharging path toward a discharging port.

As illustrated in FIG. 6C, when the paper P is transported to the third supplying path 23 and recording is performed on the other surface by the recording portion 14, the controller 50 controls an operation of the first flap 27*a* and positions the first flap 27*a* at the first position, and thus the paper P is guided to the curving and reversing path included in the discharging path 25. Also, the paper P in which recording (double-surface printing) is performed on both sides of one surface and the other surface is discharged to the paper discharging tray 60 by the discharging portion 30 from the discharging port 26.

Moreover, when single-surface printing, in which recording is performed only on a single surface of the paper, is performed on the paper P, in the same manner as FIG. 6C, the controller 50 positions the first flap 27*a* at the first position, and guides the paper P to the discharging path 25 without transporting the paper P to the branch path 24.

Here, in a case in which recording is performed on a plurality of the paper, the recording portion 14 performs recording on the next paper S (refer to FIG. 7) while the paper P, which is completely recorded on by the recording portion 14, is transported through the discharging path 25. When the double-surface printing is performed on the paper S, the paper S in which recording to one surface is complete is guided to the branch path 24 in the same manner as FIG. 6A.

Figure 7:
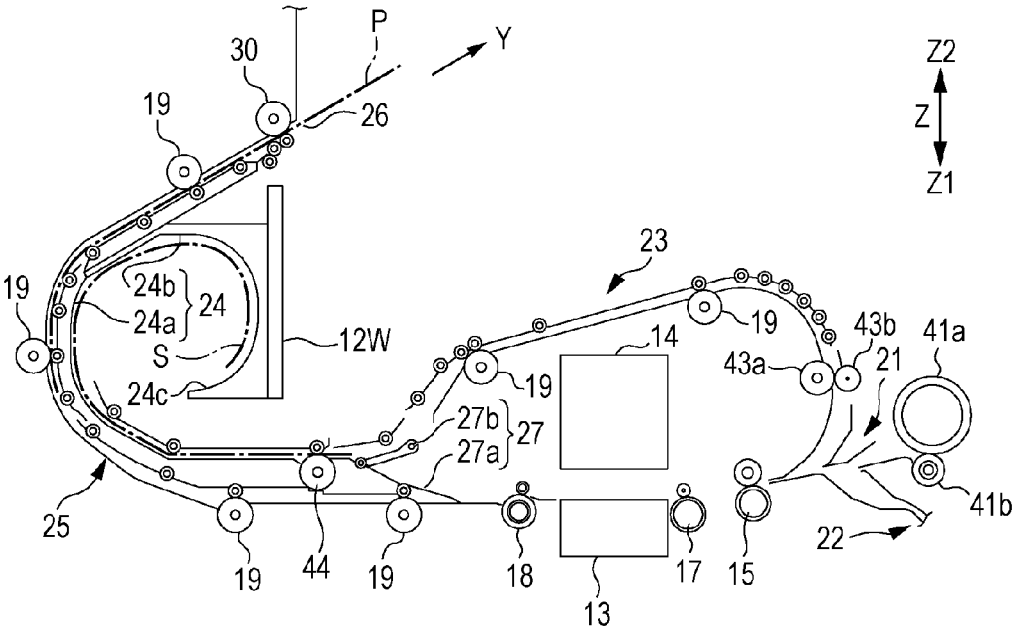
FIG. 7 is a schematic view illustrating a position relationship of paper in a printer at the time of continuously recording on a plurality of paper.

That is, as illustrated in FIG. 7, a next paper S is transported through the branch path 24 while a preceding paper P is discharged from the discharging port 26 to the paper discharging tray 60. If the downstream side branch path 24*b,* which is the downstream side part of the branch path 24, extends along the discharging path 25 in the same manner as the upper stream side branch path 24*a* so that the dead end thereof is open to a lower side of the discharging port 26, there is a concern that the paper P and the paper S are in contact with each other according to timing and interfere with each other.

Particularly, in a case in which the double-surface printing is performed on the paper S elongated in the transportation direction, the front edge of the paper S greatly protrudes from the lower side of the discharging port 26 when a rear end of the paper S penetrates through the second flap 27*b*.

When the front edge of the paper S greatly protrudes from the lower side of the discharging port 26, the paper is discharged from the discharging port 26 and dropped into the paper discharging tray 60 so as to be in contact with the paper P, therefore, there is a concern that the paper is not appropriately mounted in the paper discharging tray 60. In addition, there is also a concern that the front edge of the paper S is in contact with a paper group which is mounted in the paper discharging tray 60 in advance, and a part of the paper group drops off the paper discharging tray 60. Here, in the printer 11 in the embodiment, a path part of the branch path 24 is accommodated in the case 12, and thus a concern of interfering with the paper P discharged from the discharging port 26 is reduced (refer to FIG. 1 and FIG. 7).

Next, an action when the paper P is discharged from the discharging port 26 will be described.

The paper P, in which a single surface or double surfaces thereof are recorded by ejecting the ink using the recording portion 14, is transported to the discharging port 26 via the discharging path 25 including the curving and reversing path in the transportation path 20. Also, the paper P discharged from the discharging port 26 by the discharging portion 30 is discharged in a state in which the curved shape is formed by the first contact portion 70 and the second contact portion 80 provided in the discharging port 26.

Figure 8:
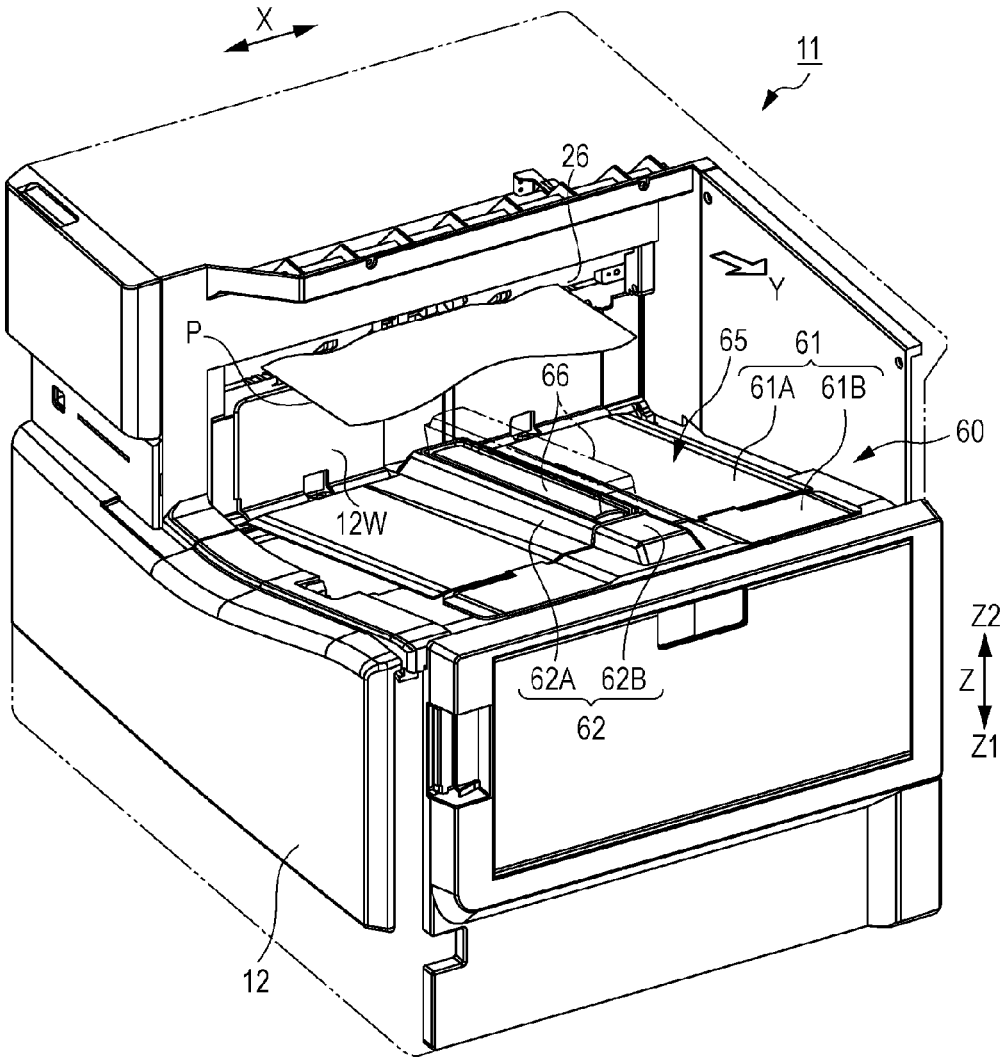
FIG. 8 is a perspective view of the printer, which illustrates a state in which the paper is discharged from the discharging port.
Figure 9:
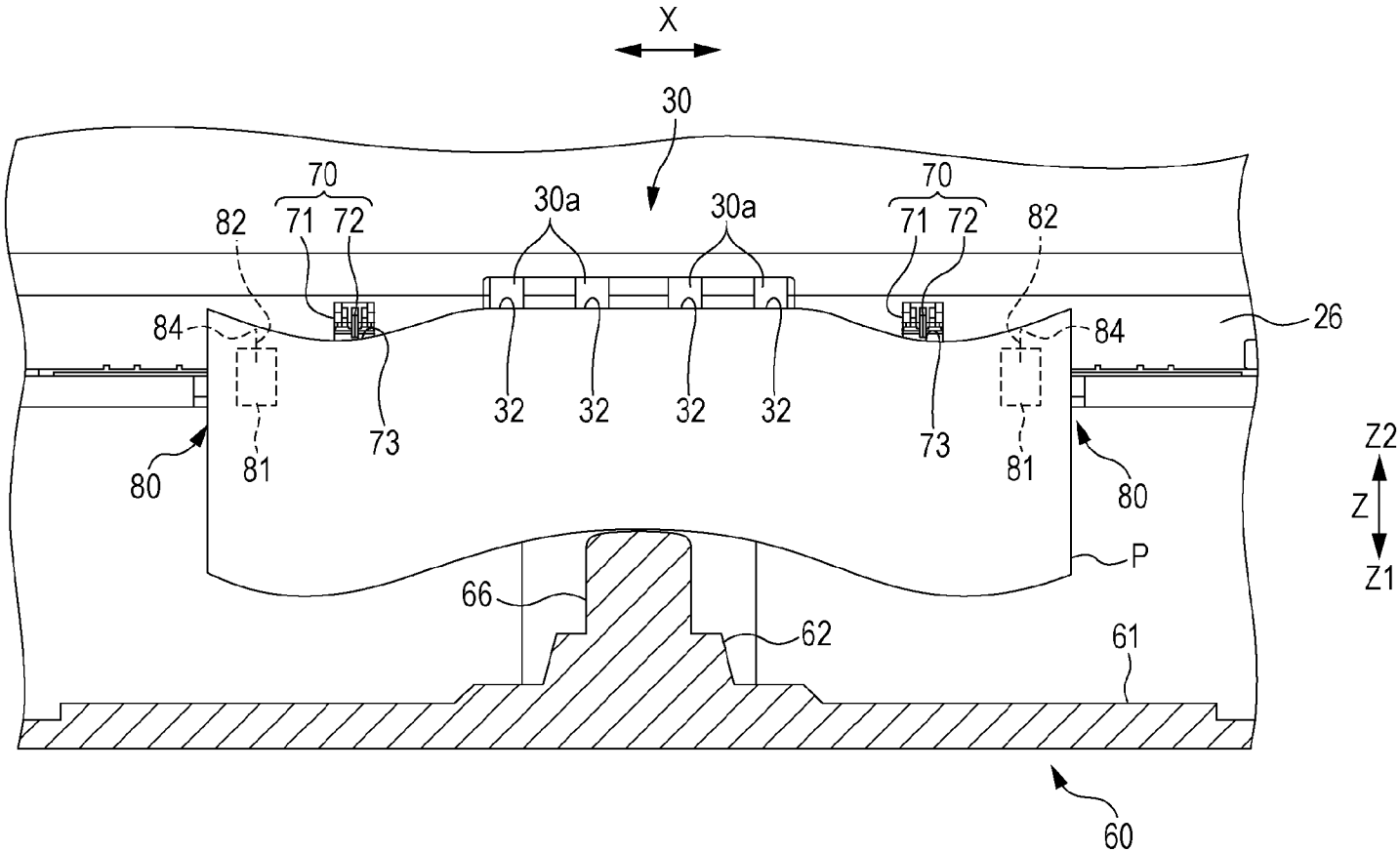
FIG. 9 is a front view illustrating the discharging port in FIG. 8.

Then, as illustrated in FIG. 8 and FIG. 9, in the paper P discharged from the discharging port 26, when seen from a front surface of the discharging port 26, a curved shape like a wave shape is formed throughout a paper surface of the paper P in the width direction X. The curved shape is formed to be a posture in which, in the width direction X, the center portion of the paper P is pinched by the discharging portion 30, and both positions, which become the outside further than the center portion, are pressed downward by the first contact portion 70 in the vertical lower side Z1, and further, both positions which become the outside are pressed upward by the second contact portion 80 in the vertical upper side Z2.

Moreover, in the paper P in which recording is performed by the recording portion 14, the recording surface is expended by the ink ejected onto the recording surface. When the recording surface is expended, curling is likely to be generated on the paper P, which is a convex shape on the recording surface side. As the printer 11 of the embodiment, in a so-called face-down type printer 11 which discharges the paper to the paper discharging tray 60 in a posture in which the recording surface thereof is positioned in the vertical lower side Z1 at the time of the single-surface printing, there is a high possibility of generating curling in the paper P which is a convex shape in the vertical lower side Z1. Therefore, in the face-down type printer 11, the curved shape of the vertical lower side Z1 is formed at a position which is on the outside further than the center portion of the paper P in the width direction X, and thus the curling is corrected.

Incidentally, the protrusion rib 66 provided in the center portion of the paper discharging tray 60 in the width direction X curves both ends of the paper P in the vertical lower side Z1 by supporting the center portion of the paper P which is discharged from the vertical direction lower side Z1, and thus curling which is the convex shape in the vertical lower side Z1 is corrected.

However, in a case of the double-surface printing in which the recording is performed on the both surfaces of the paper, the direction of the curling generated is different in every paper P, according to a difference of an ejecting amount of the ink in one surface and the other surface or a difference of a dried degree of the ink which are respectively ejected. For example, in a case in which recording, in which relatively large amount of the ink is ejected onto a surface of the vertical direction upper side Z2 of the paper P discharged from the discharging port 26 compared to a lower side surface thereof, is performed, the paper P has a high possibility of generating curling which becomes a concave shape in the vertical upper side Z2.

Figure 10:
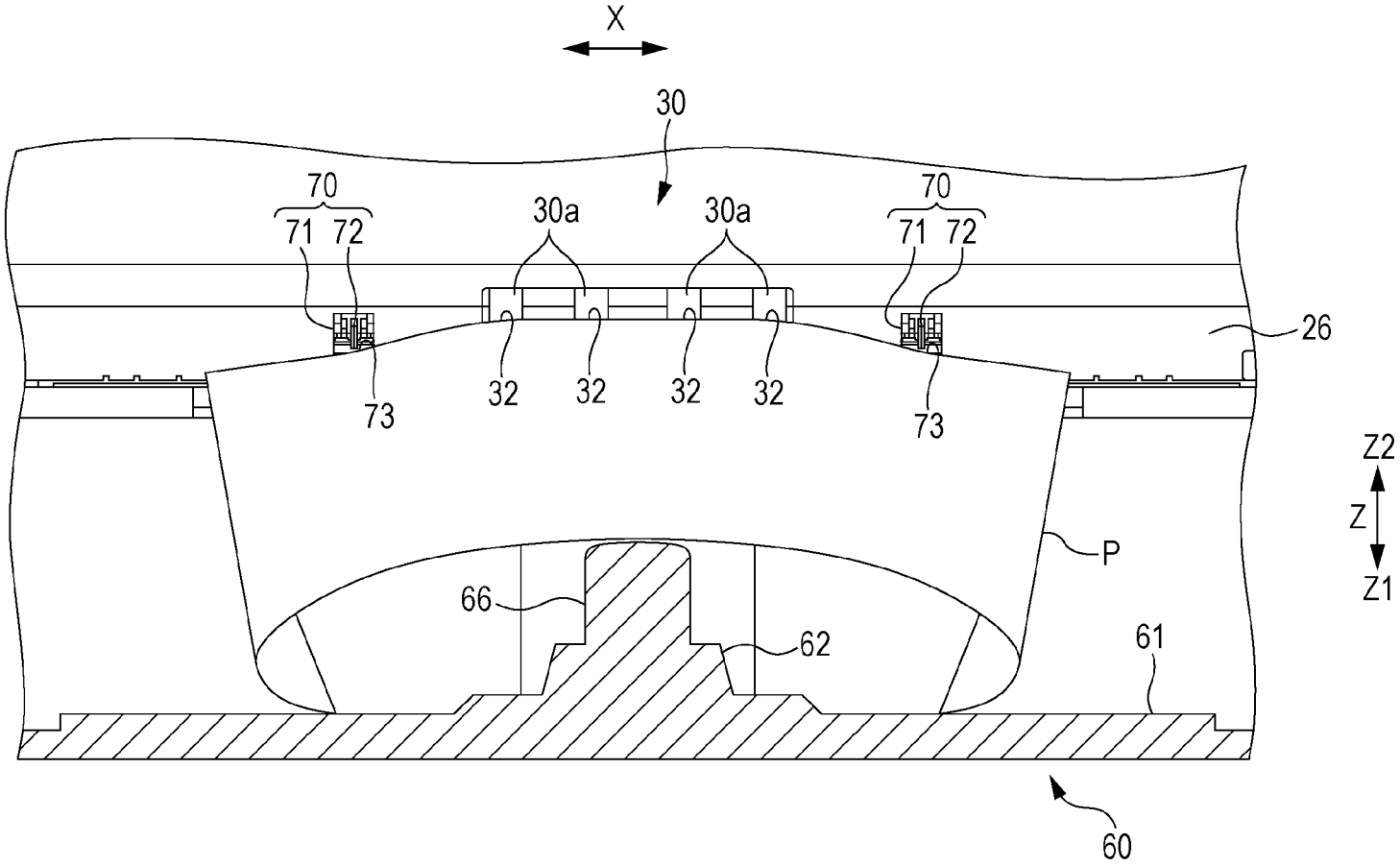
FIG. 10 is a front view illustrating the discharging port in the printer in which a second contact portion is not provided as a comparative example.

As an comparative example illustrated in FIG. 10, in a case of the face-down type printer in which only the curved shape of the vertical lower side Z1 is formed on the paper P so as to discharge the paper, at each position which becomes the outside further than the center portion of the paper P in the width direction X by the first contact portion 70, the curling, which has a high probability of happening and becomes a concave shape generated in the vertical lower side Z1 at the time of the single-surface printing, can be properly corrected. However, with respect to the curling which becomes a concave shape in the vertical upper side Z2 generated by the double-surface printing, or the like, the curling is not easily corrected, and contrarily, the degree of the curling is increased.

When the degree of the curling which becomes a concave shape in the vertical upper side Z2 generated in the paper P is enhanced, both end portions in the width direction X of the paper P are greatly recurvated, and a part of a surface which is the vertical direction upper side Z2 faces the mounting surface 61 of the paper discharging tray 60. When the paper P in this state is discharged to the paper discharging tray 60, there is a concern that the both end portions of the paper P are bent by being in contact with the mounting surface 61 of the paper discharging tray 60, and is not preferably mounted in the paper discharging tray 60.

Here, the printer 11 in the embodiment is capable of correcting any upward and downward curling provided in the second contact portion 80.

Moreover, the same manner as described above is applied to a face-up type printer which performs recording in a posture in which the recording surface is positioned in the vertical direction upper side Z2 at the time of the single-surface printing. That is, the printer 11 is capable of correcting both directions of curling in the vertical upper side Z2 and the vertical lower side Z1 as well as one direction of curling.

Figure 12:
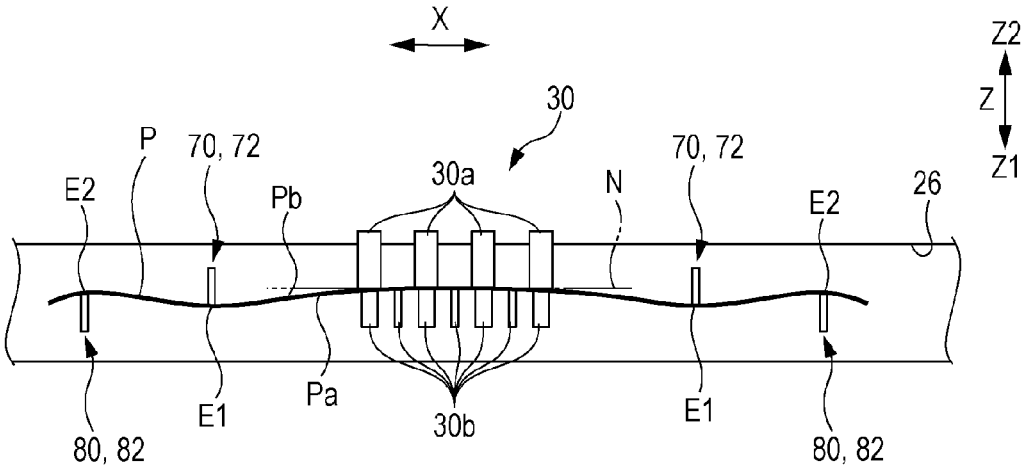
FIG. 12 is a schematic view describing an arrangement of a first contact portion, a second contact portion, and a discharging portion.

FIG. 12 is a view schematically describing arrangement of the first contact portion 70, the second contact portion 80, and the discharging portion 30 provided in the discharging port 26 of FIG. 3, when seen in the downstream side in the discharging direction Y. As described above, the discharging portion 30 is a rotation member which is rotated while pinching the paper P, and discharges the paper P by the discharge driving roller 30*a* and the discharge driven roller 30*b*. The discharging portion 30 is provided at the center portion in the width direction X of the discharging port 26.

A pinched position (nipped position) N of FIG. 12 is a position at which the paper P is in contact with the discharge driving roller 30*a* and the discharge driven roller 30*b* so as to be pinched therebetween, and is at a position (third medium contact portion 32 of FIG. 9) of a part in contact with the paper P in the discharge driven roller 30*b* of FIG. 3.

The first region E1, which is at a position of both outsides further than the discharging portion 30 in the width direction X of the discharged paper P of FIG. 12, is in contact with the roller 72 constituting the first contact portion 70 at a position of the lower side Z1 in the vertical direction Z by the pinched position N.

The second regions E2, which are respectively positioned on the outside further than the first region E1 in the width direction X of the discharged paper P, is in contact with the roller 82 constituting the second contact portion 80 in a position of the upper side Z2 in the vertical direction Z further than the first region E1.

A rotating shaft (not illustrated) of the discharge driving roller 30*a* extends in the width direction X, and the rotating shaft is rotatedly driven by a motor (not illustrated) provided at the outside of the width direction X of the discharging port 26. For this reason, since the rotating shaft of the discharge driving roller 30*a* is disposed at a position where the first contact portion 70 and the second contact portion 80 are not overlapped with each other in the vertical direction Z, the discharge driving roller 30*a* is provided at the upper side Z2 by the discharge driven roller 30*b*.

A plurality of the second contact portions 80 are arranged side by side in the width direction X, and a supporting region of the width direction X which supports an end portion of the paper P from the lower side Z1 may be elongated.

Hitherto, the printer 11 of FIG. 1 in the embodiment described above includes the recording portion 14 which records the recording surface of the paper P, the discharging path 25 which allows the paper P, on which recording is performed by the recording portion 14, to be discharged, the discharging port 26 which is successive in the discharging path 25 and functions as a discharging opening portion where the paper P is discharged in the discharging direction Y, the discharging portion 30, which is provided at the center portion in the width direction X intersecting with the discharging direction Y, is a rotation member rotating while pinching the paper P, and discharges the paper P by the discharge driving roller 30*a* and the discharge driven roller 30*b* in the discharging port 26 of FIG. 12, a first operating portion which operates the first region E1 at the outside further than the discharging portion 30 in the width direction X of the discharged paper P so as to make it positioned on the lower side Z1 (first direction side) further than the pinched position N where the discharge driving roller 30*a* and the discharge driven roller 30*b* pinch the paper, in a recording surface intersecting direction (vertical direction Z) in which surfaces Pa and Pb which are the recording surfaces, and a second operating portion which operates the second regions E2 respectively in the outside further than the first region E1 in the width direction X of the discharged paper P so as to make it positioned on the upper side Z2 (second direction side) further than the first region E1 in the vertical direction Z.

In a position on the lower side Z1 further than the pinched position N, the first operating portion in the embodiment is configured to have the first contact portion 70 which is in contact with the surface Pb of the upper side Z2 in the first region E1 of the discharged paper P. In addition, in a position on the upper side Z2 further than a position with which the first contact portion 70 is in contact, the second operating portion in the embodiment is configured to have the second contact portion 80 which is in contact with the surface Pa of the lower side Z1 in the second region E2 of the discharged paper P.

According to the above described embodiment, effects as follows can be obtained.

(1) When seen from the downstream side of the discharging direction Y where the paper P is discharged, a curved shape protruding to the lower side Z1 in the vertical direction Z on the first region E1 and a curved shape protruding to the upper side Z2 in the second region E2 are formed. That is, the paper P is discharged from the discharging port 26 in a shape in which a curved shape, which is an undulated wavy shape, is formed throughout in the width direction X. For this reason, the curved shape, which is generated in the paper P and protrudes to the lower side Z1 or the upper side Z2 caused by a recording operation of the recording portion 14, is suppressed. Therefore, the curling can be corrected regardless of the direction of the curling generated in the paper P.

(2) When the curved shape is formed on the paper P, with respect to the first medium contact portion 73 in contact with the paper P of the first contact portion 70 of FIG. 9, the second medium contact portion 84 in which the second contact portion 80 is in contact with the paper is a high position in the vertical direction. Therefore, the curved shape can be preferably formed on the paper P.

(3) When the paper P is discharged from the discharging port 26, the paper P is in contact with the first contact portion 70 and the second contact portion 80, in a state in which the center portion in the width direction is supported from the bottom by the third medium contact portion 32 included in the discharging portion 30. Therefore, a curve of the paper P can be significantly corrected by coming into contact with the first contact portion 70 and the second contact portion 80.

(4) the first medium contact portion 73 in contact with the paper P of the first contact portion 70 and the second medium contact portion 84 in contact with the paper P of the second contact portion 80 are positioned on a lower position than the third medium contact portion 32 in the vertical direction. Therefore, since these portions do not strongly in contact with the paper P, a defect of discharging of the paper P can be suppressed.

(5) In the discharging port 26, the first contact portion 70 is positioned to be deviated from the downstream side in the discharging direction Y further than the second contact portion 80. That is, when the paper P is discharged from the discharging port 26, first, the curved shape of the vertical upper side is formed by the second contact portion 80, and then the curved shape of the vertical lower side is formed by the first contact portion 70. Therefore, it is possible to suppress a discharging defect of the paper P such as a paper jam when the curved shape of the vertical upper side and the curved shape of the vertical lower side are formed on the paper P.

(6) The holder 81 constituting the second contact portion 80 is provided to be rotatable with respect to the discharging port 26 by the shaft 83. That is, a position in the vertical direction of the second medium contact portion 84, which is in contact with the paper P in the second contact portion 80, can be displaced, and a strong degree of contacting the second contact portion 80 with respect to the paper P can be changed. Therefore, the strong degree of contact of the curved shape of the vertical upper side formed on the paper P by the second contact portion 80 can be changed.

(7) Since the protrusion rib 66 is positioned on the center portion of the paper discharging tray 60 in the width direction, curling with respect to the paper P mounted in the paper discharging tray 60 can be corrected.

(8) The discharging port 26 connected to the dead end of the discharging path 25 is open to the case 12, but the branch path 24, which is provided to have a medium length or more of the paper P in the transportation direction, is provided to be accommodated in the case 12. Therefore, it is possible to suppress an interference of the paper S, which is transported through the branch path 24 is branched from the discharging path 25, to the paper P discharged from the discharging path 25 in the downstream side of the transportation direction further than the recording portion 14.

(9) The branch path 24 is configured to have a curved path. That is, in the case 12, increasing in size of the apparatus can be suppressed compared to a case in which the branch path 24 is configured to have only a straight line path.

(10) The paper P transported through the branch path 24 becomes a posture in which he recording surface recorded by the recording portion 14 is curved to an inner side. Generally, the paper P is likely to have curling, in which the recording surface becomes a concave surface, by attaching the ink by the recording portion 14 or heating a recording material such as toner for being fixed. Therefore, it is possible to expect that an effect in which the curling generated on the paper P is corrected in the branch path 24.

(11) the paper P transported through the branch path 24 is guided to a rear surface which is a surface opposite to the recording surface by being in contact with the guiding surface 24*c* included in the downstream side branch path 24*b*. Therefore, a deteriorate of a recording quality of an image, which is recorded on the recording surface of the paper P transported through the branch path 24, can be suppressed.

(12) When seen from the width direction of the paper P intersecting with (orthogonal to) the transportation direction of the paper P, since the branch path 24 is provided at an opposite side of the paper discharging tray 60 with respect to the discharging port 26, increasing of a bulk of the printer 11 can be suppressed, compared to, for example, a case in which the branch path 24 is provided at a region which becomes the lower side of the paper discharging tray 60 in the vertical direction. That is, increasing in size of the apparatus can be suppressed.

(13) The branch path 24 is provided so as to be accommodated in the case 12. In the same manner as the discharging path 25, the paper P transported through the branch path 24 is not exposed from the case 12, compared to a configuration in which the dead end of the branch path 24 is opened to the case 12, and thus a defect of printing in which a user forcedly pulls the paper during the double-surface printing can be suppressed.

Figure 13:
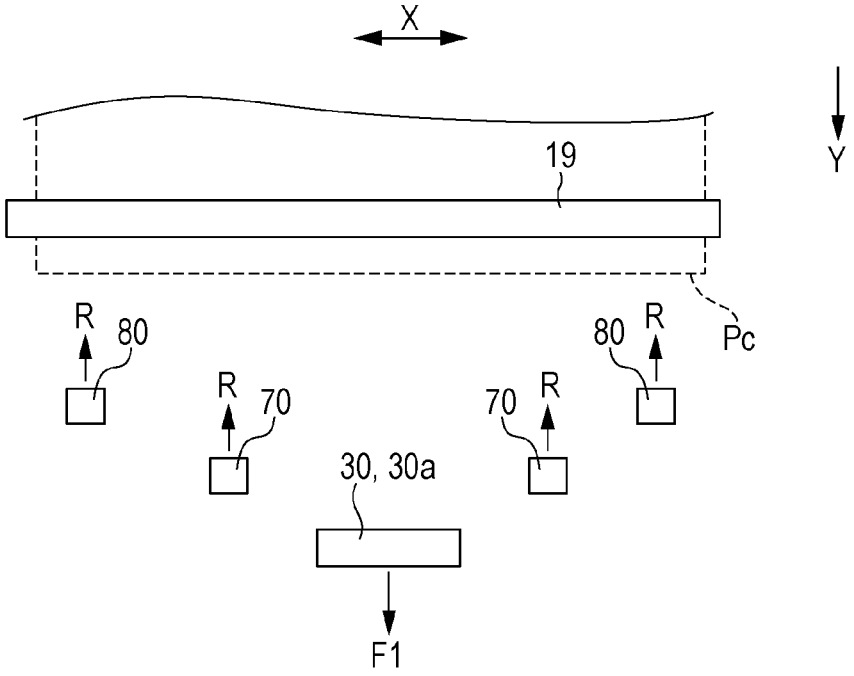
FIG. 13 is a schematic view describing the discharging portion which is disposed at a downstream side further than the first contact portion and the second contact portion in a discharging direction.

(14) The discharging portion 30 is provided at the downstream side further than the first contact portion 70 and the second contact portion 80. Accordingly, a jam of the paper P can be suppressed. FIG. 13 is a view schematically illustrating that the discharging portion 30 is disposed at the downstream side in the discharging direction Y further than the first contact portion 70 and the second contact portion 80, when seen from the upper side Z2 in the vertical direction Z.

The pair of transportation rollers 19 of FIG. 13 is the pair of transportation rollers 19 which is provided at the most downstream side in the discharging direction Y of FIG. 1, and is configured to have a transportation driving roller (not illustrated) and a plurality of the serrated rollers (not illustrated).

The transportation driving roller extends longer than a width of the width direction X of the paper P, and the plurality of serrated rollers are disposed in a range longer than the width of the paper P. For this reason, in a state in which the paper is pinched between the pair of transportation rollers 19 throughout the whole width thereof, the paper P is transported to the downstream side by the pair of transportation rollers 19.

Therefore, when a front edge portion Pc of the paper P is transported to the downstream side by being in contact with the second contact portion 80 and the first contact portion 70, even when a resistance R toward the upper stream side from the second contact portion 80 and the resistance R toward the upper stream side from the first contact portion 70 are generated, the front edge portion Pc of the paper P is slightly deformed with respect to the width direction X, and the paper is transported in a stable posture.

The discharging portion 30 of FIG. 13 is provided on the downstream side further than the first contact portion 70 and the second contact portion 80. For this reason, when the front edge portion Pc of the paper P transported to the downstream side of the discharging direction Y is in contact with the first contact portion 70 and the second contact portion 80, the discharging portion 30 is positioned on the downstream side further than the front edge portion Pc and does not receive a transportation force F1 by the rotated driving force of the discharge driving roller 30*a* of the discharging portion 30. Accordingly, the front edge portion Pc of the paper P is deformed in the width direction X, and thus the jam of the paper P can be suppressed.

Figure 14:
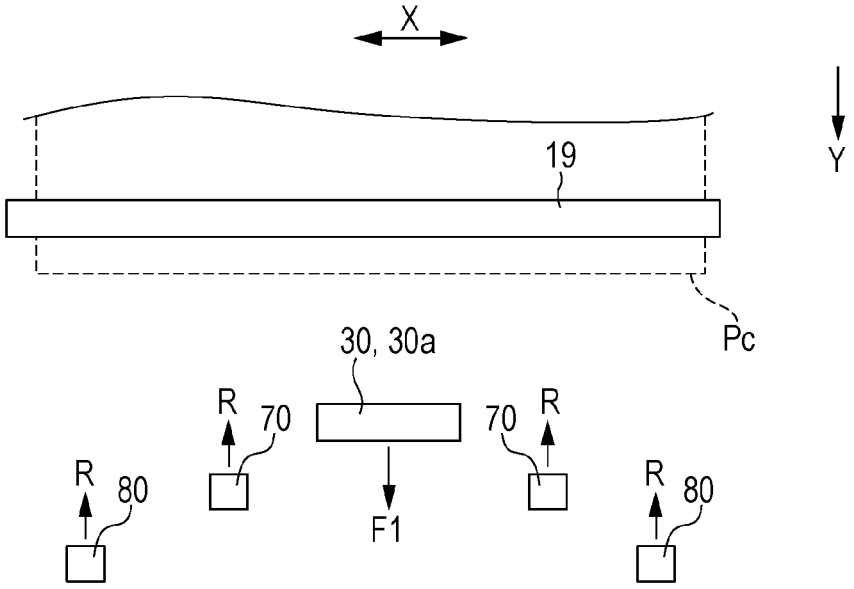
FIG. 14 is a schematic view describing the discharging portion which is disposed at an upper stream side further than the first contact portion and the second contact portion in the discharging direction.

FIG. 14 is a view when seen from the upper side Z2 in the vertical direction Z for comparing, and is a view schematically illustrating that the discharging portion 30 is disposed at the upstream side in the discharging direction Y further than the first contact portion 70 and the second contact portion 80.

The discharge driving roller 30*a* and the discharge driven roller 30*b* constituting the discharging portion 30 is provided at the center portion in the width direction X. For this reason, the transportation force F1 toward the downstream side is generated in the center portion in the width direction X of the front edge portion Pc by the rotated driving force of the discharge driving roller 30*a*.

Meanwhile, at the outside of the discharging portion 30 in the width direction X of the front edge portion Pc, the resistance R toward the upper stream side from the first contact portion 70 and the resistance R toward the upper stream side from the second contact portion 80 are generated. Accordingly, the front edge portion Pc is deformed with respect to the width direction X, and a so-called paper jam may be generated.

Therefore, in a case in which the discharging portion 30 of FIG. 13 is provided on the downstream side further than the first contact portion 70 and the second contact portion 80, compared to a case in which the discharging portion 30 of FIG. 14 is provided at the upper stream side further than the first contact portion 70 and the second contact portion 80, there is an advantage in that the transportation force F1 of the discharging portion 30 is not affected, when the front edge portion Pc of the transported paper P is in contact with the first contact portion 70 and the second contact portion 80.

Also, as illustrated in FIG. 14, the discharging portion 30 may be provided at the upper stream side further than the first contact portion 70 and the second contact portion 80. According to the configuration described above, the discharging portion 30 can be disposed at the inner side of the case 12, and thus contact of a user's hand to the discharge driving roller 30*a* and the discharge driven roller 30*b* which are rotatedly driven is suppressed.

In addition, the above described embodiment may be modified as follows.

Figure 11:
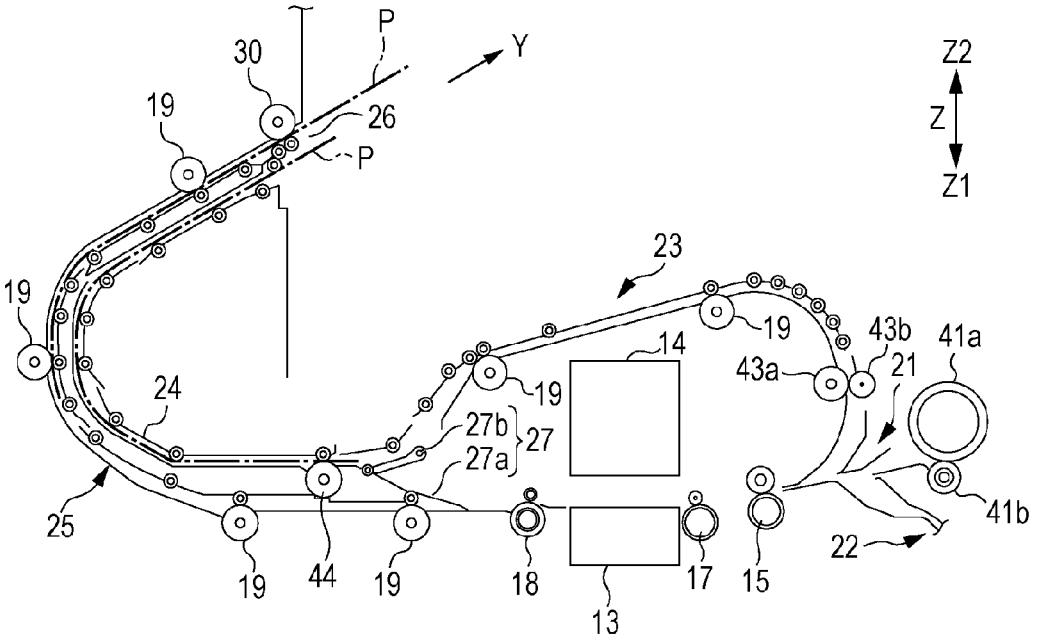
FIG. 11 is a schematic view illustrating a modification example of the printer.

In the embodiment described above, as illustrated in FIG. 11, the printer 11 may have a configuration in which the dead end of the branch path 24 is opened to the right below of the discharging port 26. In this configuration, from the dead end of the branch path 24 to an end portion of the paper P are exposed according to a length of the transportation direction of the paper P. Here, the controller 50 controls a transportation timing of the paper P so that the paper P is not exposed by the discharging port 26 and the dead end of the branch path 24 at the same time, and thus the discharging path 25 and the paper P transported through the branch path 24 are not interfered with each other.

In the embodiment described above, at least one of the first contact portion 70 and the second contact portion 80 is not limited to a strong degree of contacting as much as the curved shape is formed on the paper P. For example, it may have a degree of contacting as much as the curling generated in the paper P caused by attaching of the ink is suppressed. That is, a posture of the paper P at the time of being discharged from the discharging port 26 of the printer 11 in the embodiment is not limited to a posture of an undulated wavy shape.

In the embodiment described above, the first contact portion 70 and the second contact portion 80 may be provided to overlap each other when seen from the width direction, so that the curved shape is formed with respect to the paper P discharged from the discharging port 26 at the same time. According to the configuration, the portions can be provided at a space smaller than that of a configuration in which each portion in the discharging direction Y is provided to be staggered, and thus increasing in size of the apparatus can be suppressed.

In the embodiment described above, the second contact portion 80 provided in the discharging port 26 may be provided to be movable in the width direction. According to the configuration, in the width direction, a position, where the curved shape of the vertical upper side is formed on the paper P by the second contact portion 80, can be changed. Therefore, it is possible to correspond to the paper P of various sizes.

In the embodiment described above, at least one of the second medium contact portions 84 included in the first medium contact portion 73 and the second contact portion 80 included in the first contact portion 70 may be provided so that the downstream side in the discharging direction Y at the time of being in contact with the paper P can be changed. For example, at least one of the first contact portion 70 and the second contact portion 80 may be made of a member having flexibility such as plastic or rubber, or may be formed to be fluctuated in response to contact of the paper P. According to the configuration, when the curved shape is formed on the paper P, at least one of the first contact portion 70 and the second contact portion 80 are not strongly in contact with the paper P more than necessary. Therefore, when the curved shape is formed on the paper P, a discharging defect of the paper P due to strong contact of the paper P with the first contact portion 70 and the second contact portion 80 can be suppressed. In addition, strongness of contacting can be changed according to a rigidity of medium.

In the embodiment described above, the second medium contact portion 84 included in the second contact portion 80 may be provided at a position in the vertical direction lower than the first medium contact portion 73 included in the first contact portion 70. A defect can be reduced, which is generated in a case in which a medium having strong rigidity such as heavy paper is discharged so as not to strike up and curve the both end portions in the width direction of the paper P.

In the embodiment described above, the second contact portion 80 is not limited to a lever which displaces strongness of contacting with respect to the paper P by rotating around the shaft 83 as a center. For example, in a rib protruding from the vertical direction lower side, strongness of contact with respect to the paper P may be displaced by displacing an amount of protrusion.

In the embodiment described above, the first contact portion 70 may be provided at the upper stream side in the discharging direction Y further than the second contact portion 80.

In the embodiment described above, in the discharge driven rollers 30*b* constituting the discharging portion 30, a discharge driven roller 30*b* which does not face the discharge driving roller 30*a* may not be provided. In addition, as well as a plurality of pairs, a pair may be provided.

In the embodiment described above, the first contact portion 70 and the second contact portion 80 may not respectively have the roller 72 and the roller 82. Without the roller 72 and the roller 82, the curved shape can be formed on the paper P. In this case, the first medium contact portion 73 is a lower end part of the protrusion portion 71, and the second medium contact portion 84 is a upper end part of the holder 81.

In the embodiment described above, the second contact portion 80 may not have a configuration in which a state illustrated in FIG. 5C can be displaced from a state illustrated in FIG. 5A. If the second medium contact portion 84 is lower than the third medium contact portion 32 even when it is not positioned on a position in the vertical direction lower than the first medium contact portion 73, a discharging defect of the paper P is suppressed.

In the embodiment described above, the discharging portion 30 is not limited to a pair of the rollers, and may be a conveyor such as a belt.

In the embodiment described above, the first contact portion 70 and the second contact portion 80 provided in the discharging port 26 may be provided multiple in the width direction.

In the embodiment described above, the upper stream side branch path 24*a* and the downstream side branch path 24*b* constituting the branch path 24 are provided separately, a part surrounded by a broken line illustrated in FIG. 1 may be configured to be detachable from the case 12. According to the configuration, even when a transportation defect such as a paper jam is generated in the branch path 24, the upper stream side branch path 24*a* is detached from the downstream side branch path 24*b*, and thus the paper P jammed in the branch path 24 can be detached. Therefore, maintenance properties of the printer 11 are improved.

In the embodiment described above, a part which is the downstream side further than the pair of branch path rollers 44 in the upper stream side branch path 24*a* may guide only the paper P from a rear surface opposite to the recording surface of the paper P. According to the configuration, in the recording surface of the paper P transported through the branch path 24, an area thereof in contact with configuration components in the branch path 24 is reduced, and thus a defacement of the recording surface can be suppressed.

In the embodiment described above, the branch path 24 may be a roller which winds the paper P by setting the recording surface thereof as an inner side. According to the configuration, an effect of further correcting curling can be obtained.

In the embodiment described above, the branch path 24 is not limited to a configuration in which a shape thereof is curved along the inner side of the discharging path 25. For example, it may be curved along the outside of the discharging path 25. In addition, the embodiment is not limited to a path in which the discharging path 25 is curved, and may have a configuration in which the discharging path 25 extends straightly.

In the embodiment described above, the recording portion 14 is not limited to a line head which is provided to extend in the width direction, and may be a serial head scanning the paper P.

Embodiment 2

In Embodiment 2, a recording apparatus, in which directions of protrusion of the curved shape provided on the first region E1 and the second region E2 are respectively opposite to a direction in which protrusion of the curved shape formed in Embodiment 1, will be described.

Figure 15:
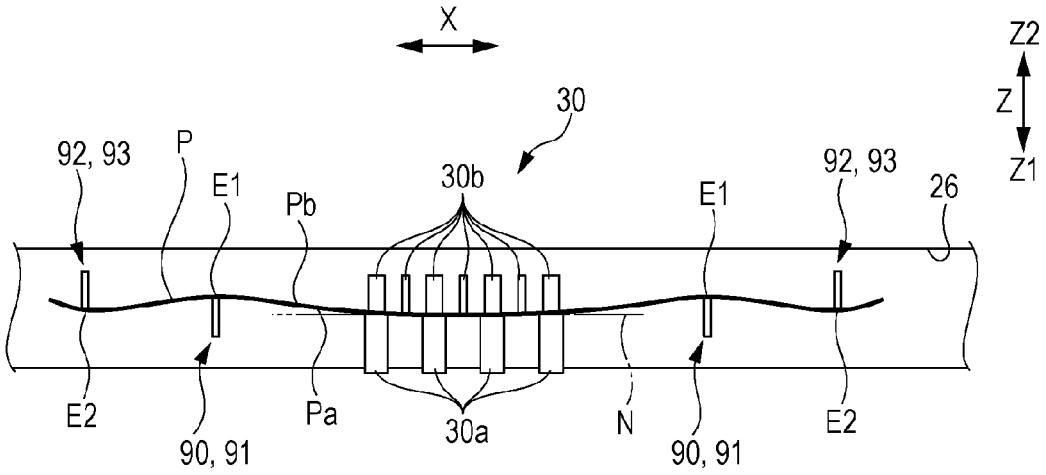
FIG. 15 is a schematic view describing an arrangement of a first contact portion, a second contact portion, and a discharging portion in Embodiment 2.

In Embodiment 2, FIG. 15 is a view seen from the downstream side in the discharging direction Y, and is a view schematically illustrating an arrangement of the first contact portion 90, the second contact portion 92, and the discharging portion 30 included in the discharging port 26.

The roller 91 constituting the first contact portion 90 is in contact with the first region E1 at a position of the upper side Z2 than the pinched position N which is pinched between the discharge driving roller 30*a* and the discharge driven roller 30*b*, and operates as the first operating portion so that the first region E1 is position at the upper side Z2 (first direction side) further than the pinched position N.

The roller 93 constituting the second contact portion 92 is in contact with the second region E2 at a position of the lower side Z1 than the first region E1, and operates as the second operating portion so that the second region E2 is positioned on the lower side Z1 (second direction side) than the first region E1.

Accordingly, when seen from the discharging direction Y where the paper P is discharged, the curved shape protruding to the upper side Z2 is formed on in the first region E1, and the curved shape protruding to the lower side Z1 is formed on the second region E2. That is, the paper P is discharged from the discharging port 26 in a state in which the curved shape, which is an undulated wavy shape, is formed throughout in the width direction X.

The rotating shaft of the discharge driving roller 30*a* (not illustrated) extends in the width direction X, and the rotating shaft is rotatedly driven by a motor (not illustrated) which is provided at the outside of the width direction X of the discharging port 26. For this reason, since the rotating shaft of the discharge driving roller 30*a* is disposed at a position where the first contact portion 90 and the second contact portion 92 are not overlapped with each other in the vertical direction Z, the discharge driving roller 30*a* is provided at the lower side Z1 further than the discharge driven roller 30*b*. The other configurations of the printer in Embodiment 2 are the same as that of the printer 11 described in Embodiment 1.

Embodiment 3

Figure 16:
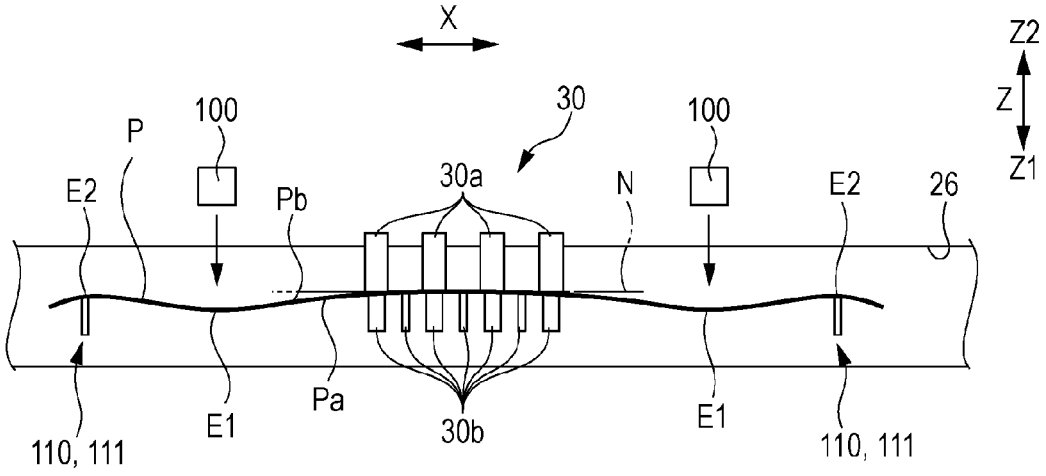
FIG. 16 is a schematic view describing an arrangement of a discharging portion, an air blowing portion, and the contact portion in Embodiment 3.

In Embodiment 3, the printer in which the first operating portion is provided as the air blowing portion will be described. FIG. 16 is a view seen from the downstream side in the discharging direction Y in Embodiment 3, and is a view schematically describing an arrangement of the discharging portion 30, air blowing portions 100, and contact portions 110 which are included in the discharging port 26.

The air blowing portion 100 as a first air blowing portion blows the air to the surface Pb of the upper side Z2 in the first region E1 of both outsides of the discharging portion 30 of the discharged paper P, and is operated as the first operating portion so that the first region E1 is positioned on the lower side Z1 (first direction side) than the pinched position N pinched between the discharge driving roller 30*a* and the discharge driven roller 30*b*. As the air blowing portion 100, for example, a centrifugal air blower 150 (refer to FIG. 19) can be used.

The rollers 111 constituting the contact portions 110 are respectively in contact with the second region E2 of the outside further than the first region E1 in the width direction X of the discharged paper P at a position of the upper side Z2 than the first region E1, and operates as the second operating portion so that the second region E2 is positioned on the upper side Z2 (second direction side) than the first region E1. The contact portion 110 has the same configuration of the second contact portion 80 described in Embodiment 1.

According to the configuration, the air blowing portion 100 is not in contact with the paper P, and thus an image formed on the paper P is not damaged. When seen from the discharging direction Y, the curved shape protruding to the lower side Z1 is formed on the first region E1 of the paper P by the air blowing portion 100. Also, by the contact portion 110, the curved shape protruding to the upper side Z2 is formed on the second region E2. That is, the paper P is discharged from the discharging port 26 in a state in which the curved shape, which is an undulated wavy shape, is formed throughout in the width direction X. The other configurations of the printer in Embodiment 3 are the same as those of the printer 11 described in Embodiment 1.

Embodiment 4

Figure 17:
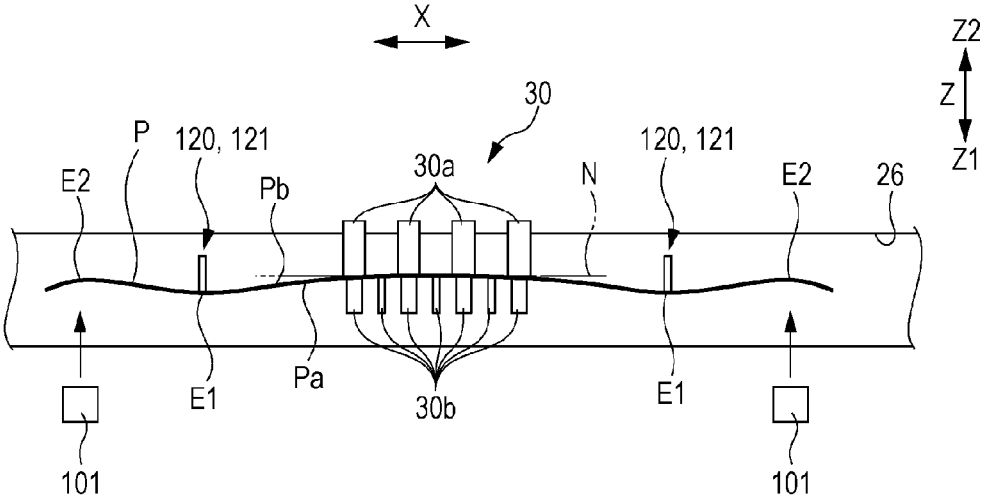
FIG. 17 is a schematic view describing an arrangement of a discharging portion, an air blowing portion, a contact portion in Embodiment 4.

In Embodiment 4, a printer in which the second operating portion functions as the air blowing portion will be described. In Embodiment 4, FIG. 17 is a view seen from the downstream side the discharging direction Y, and is a view schematically describing an arrangement of the discharging portion 30, air blowing portions 101, contact portions 120 included in the discharging port 26.

The roller 121 constituting the contact portion 120 is in contact with the first region E1 in the width direction X of the discharged paper P at a position of the lower side Z1 than the pinched position N, and operates as the first operating portion so that the first region E1 is positioned on the lower side Z1 (first direction side) than the pinched position N. The contact portion 120 has the same configuration of the first contact portion 70 described in Embodiment 1.

The air blowing portion 101 as a second air blowing portion blows the air to the surface Pa of the lower side Z1 in the second region E2, and operates as the second operating portion so that the second region E2 is positioned on the upper side Z2 (second direction side) than the first region E1.

According to the configuration, the air blowing portion 101 is not in contact with the paper P, and thus an image formed on the paper P is not damaged. When seen from the discharging direction Y, the curved shape protruding to the upper side Z2 is formed on the second region E2 of the paper P by the air blowing portion 101. Also, in the contact portion 120, the curved shape protruding to the lower side Z1 is formed on the first region E1 of the paper P. That is, the paper P is discharged from the discharging port 26 in a state in which the curved shape, which is an undulated wavy shape, is formed throughout in the width direction X. The other configurations of the printer in Embodiment 4 are the same as those of the printer 11 described in Embodiment 1.

Embodiment 5

Figure 18:
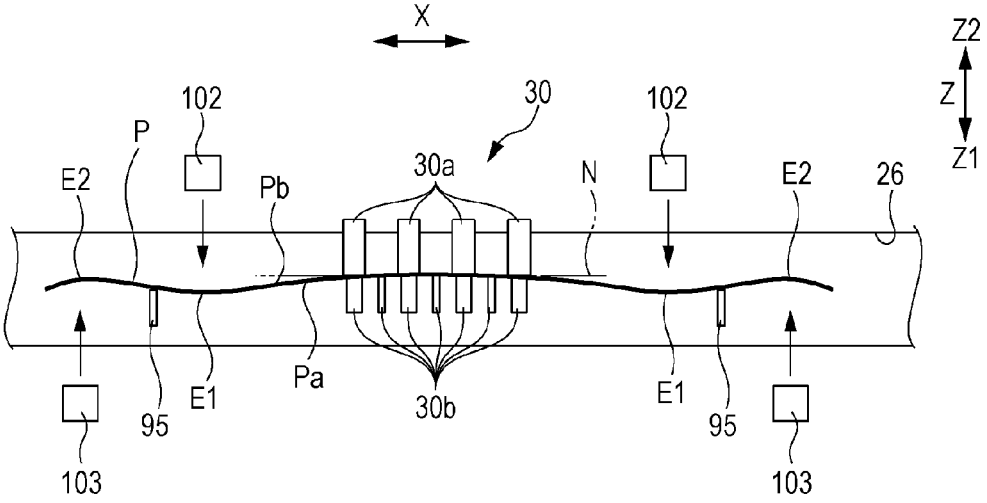
FIG. 18 is a schematic view describing an arrangement of a discharging portion and an air blowing portion in Embodiment 5.

In Embodiment 5, a printer, in which the first operating portion and the second operating portion function as the air blowing portions, will be described. In Embodiment 5, FIG. 18 is a view seen from the downstream side in the discharging direction Y, and is a view schematically describing an arrangement of the discharging portion 30, and the air blowing portions 102 and 103 included in the discharging port 26.

The air blowing portion 102 as the first air blowing portion blows the air to the surface Pb of the upper side Z2 in the first region E1, and operates as the first operating portion so that the first region E1 is positioned on the lower side Z1 (first direction side) than the pinched position N.

The air blowing portion 103 as the second air blowing portion blows to the surface Pa of the air the lower side Z1 in the second region E2, and operates as the second operating portion so that the second region E2 is positioned on the upper side Z2 (second direction side) than the first region E1.

In the width direction X, serrated rollers 95 such as star wheels are respectively provided between the air blowing portion 102 and the air blowing portion 103, and the roller 95 supports the paper P from the lower side Z1.

According to the configuration, the air blowing portions 102 and 103 are not in contact with the paper P, and thus the image formed on the paper P is not damaged. The curved shape protruding to the lower side Z1 is formed on the first region E1 of the paper P by the air blowing portion 102, and the curved shape protruding to the upper side Z2 is formed on the second region E2 by the air blowing portion 103. That is, the paper P is discharged from the discharging port 26 in a state in which the curved shape, which is an undulated wavy shape, is formed throughout in the width direction X. The other configurations of the printer in Embodiment 5 are the same as those of the printer 11 described in Embodiment 1.

Figure 19:
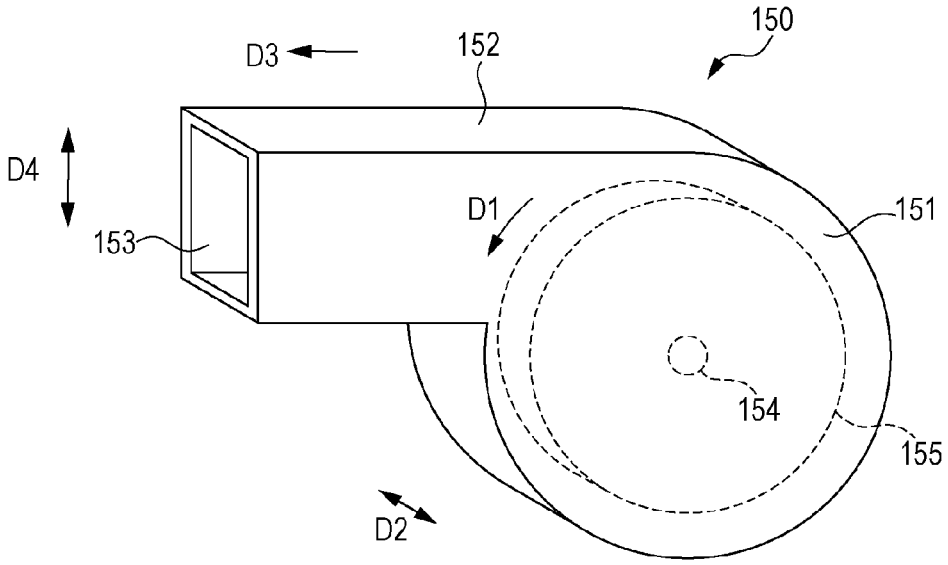
FIG. 19 is a schematic exterior perspective view of a centrifugal air blower as an example of the air blowing portion.

FIG. 19 is a schematical exterior perspective view of the centrifugal air blower 150 as an example of the air blowing portions 100, 101, 102, and 103. In the internal portion of a casing 151, a rotating body 155, which includes a plurality of wings and is rotated in a rotation direction D1 around a rotating shaft 154 of a shaft direction D2 as a base point, is included.

In the casing 151, an air blow-off part 152, in which an air suction port (not illustrated) opened in the shaft direction D2 and an opening portion 153 opened to a centrifugal direction of the rotating body 155, are provided. The centrifugal air blower 150 absorbs the air from the air suction port and blows the air to a centrifugal direction D3 from the opening portion 153 by rotating the rotating body 155 in the rotation direction D1.

Figure 20:
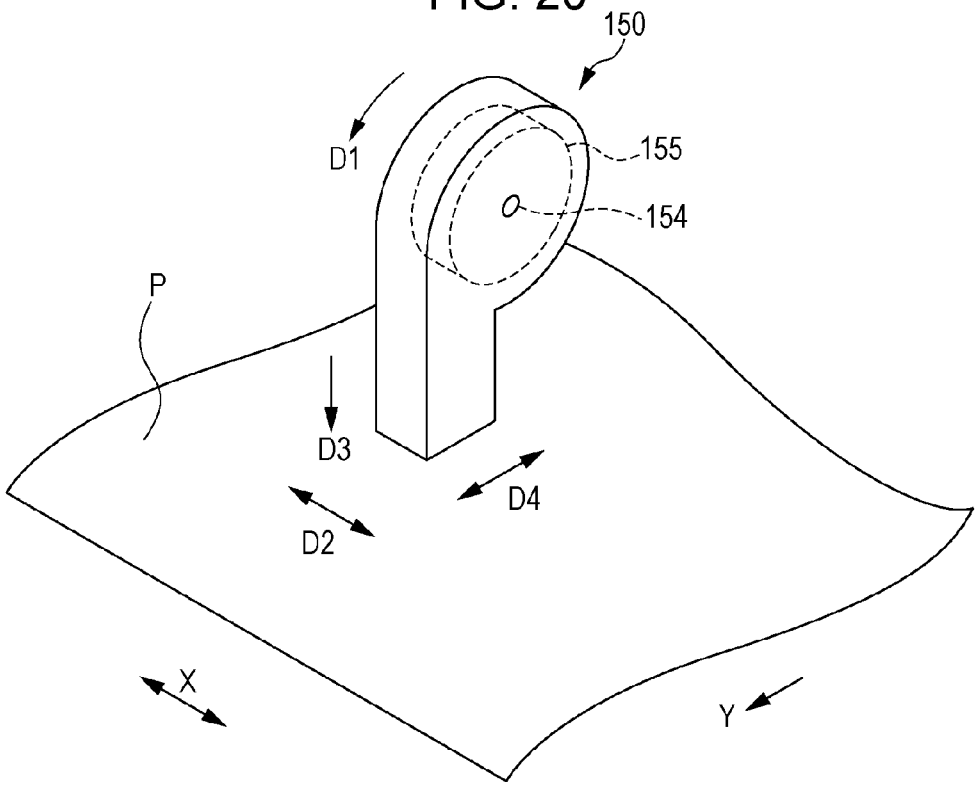
FIG. 20 is a perspective view illustrating the centrifugal air blower which blows the air with respect to a first region and a second region of the transported paper.

FIG. 20 is a perspective view illustrating the centrifugal air blower 150 which blows the air to the first region E1 and the second region E2 (refer to FIG. 16, FIG. 17, and FIG. 18) of the transported paper P. A wind velocity of the air blown from the opening portion 153 is different in a position in a height direction D4 (radius direction of rotating body 155) of the opening portion 153 of FIG. 19.

For this reason, as illustrated in FIG. 20, the centrifugal air blower 150 is disposed so that the height direction D4 of the opening portion 153 becomes the same as the discharging direction Y of the paper P. That is, the centrifugal air blower 150 is disposed so that the shaft direction D2 of the rotating shaft 154 of the rotating body 155 becomes a direction intersecting with the discharging direction Y of the paper P, that is, the width direction X.

According to this configuration described above, a difference of the wind velocity in a position of the width direction X in the opening portion 153 of FIG. 20 can be reduced, and the curved shape seen from the discharging direction Y can be stably formed on the first region E1 and the second region E2 of the paper P.

In addition, in Embodiment 3 described with reference to FIG. 16, the centrifugal air blower 150 as the air blowing portion 100 is disposed at the upper side Z2 in the vertical direction Z of the discharging portion 30 so that the shaft direction D2 of the rotating shaft 154 of the rotating body 155 becomes the width direction X, and may blow the air toward the paper P which is discharged from the discharging portion 30 and mounted on the paper discharging tray 60. Accordingly, in the center portion of the paper P, the upwardly protruding curved shape can be held.

Figure 21:
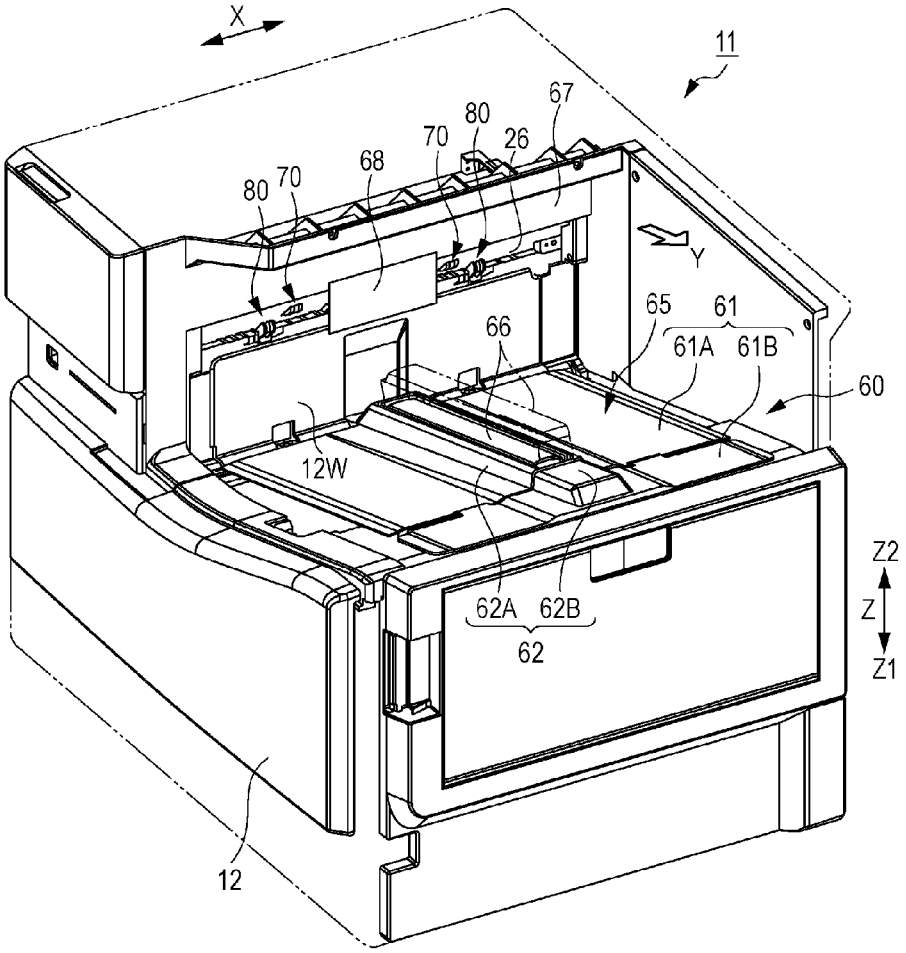
FIG. 21 is an exterior perspective view of the printer which is provided with a shielding member.

FIG. 21 is an exterior perspective view of the printer 11 included in a shielding member. FIG. 21 is an exterior perspective view of the printer 11 of FIG. 2 which includes a film member 68 as the shielding member. As illustrated in FIG. 21, at a downstream side deviated from the discharging portion 30 in the discharging direction Y, the film member 68 shielding the discharging portion 30 may be provided in the center portion of the width direction X.

An upper end portion of the film member 68 is fixed to an upper side of the case 67 of the discharging port 26, and the film member 68 is provided in a state of being hung down. The paper P discharged from the discharging port 26 can be passed a position of the film member 68 so as to press upward the film member 68.

According to the configuration described above, when the paper P is positioned on the upper stream side than the discharging portion 30, or after the paper P is passed through the discharging portion 30, even the discharge driving roller 30*a* of the discharging portion 30 is rotatedly driven, contact of a user's hand with the discharge driving roller 30*a* is suppressed.

In the embodiment described above, as illustrated in FIG. 3, a convex portion 62 is provided at a position of the mounting surface 61 corresponding to the discharging portion 30 in the width direction X; however, in the width direction X of FIG. 15, the convex portion 62 may be provided at the position of the mounting surface 61 corresponding to the first contact portion 90.

In the embodiment described above, the printer 11 as the recording apparatus may be a printer which performs recording by ejecting or discharging fluid (including liquid, a liquid material in which particles of a functioning material is dispersed or mixed with liquid, a fluid material such as gel, or a solid which can be ejected as fluid) other than ink. For example, it may be a printer which performs recording by ejecting liquid material including electrode materials, color materials (pixel materials), and the like used for manufacturing liquid crystal displays, EL (electroluminescence) displays, surface emitting displays, and the like. In addition, it may be a printer which ejects fluid material such as gel (for example, physical gel). Also, the invention can be applied to any one of these printers. Moreover, "fluid" in the invention is a concept which does not includes fluid made of only gas, and in the fluid, for example, liquid (including inorganic solvents, organic solvents, solutions, liquid resins, liquid metals (metallic melt), and the like), liquid materials, fluid materials, powder and granular materials (including granules and powder), and the like are included.

The entire disclosure of Japanese Patent Application No. 2015-039952, filed Mar. 2, 2015 and 2015-240853, filed Dec. 10, 2015 are expressly incorporated by reference herein.

What is claimed is:

1. A recording apparatus comprising:

a recording portion that performs recording on a recording surface of a medium;

a discharging path that allows the medium, on which recording is performed by the recording portion, to be discharged;

a discharging opening portion that is successive to the discharging path, and includes an opening where the medium is discharged in a discharging direction;

a discharging portion that is provided at the center portion of the width direction intersecting with the discharging direction in the discharging opening portion, and discharges the medium from the opening by a rotation member which is rotated while pinching the medium;

a first operating portion that operates for first regions positioned on both sides of a pinched position which is pinched by the rotation member, of the medium discharged by the discharging portion, in the width direction, to be positioned on a first direction side further than the pinched portion, in a recording surface intersecting direction which is a direction intersecting with the recording surface; and a second operating portion that operates for second regions positioned on both sides of a region which includes the pinched position and the first region, of the medium discharged by the discharging portion, in the width direction, to be positioned on a second direction side opposite to the first direction side further than the first region, in the recording surface intersecting direction.

2. The recording apparatus according to claim 1, wherein the first operating portion is a first contact position which is in contact with a surface of the second direction side in the first region of the discharged medium at a position of the first direction side further than the pinched position, in the recording surface intersecting direction, and wherein the second operating portion is a second contact portion which is in contact with a surface of the first direction side in the second region of the discharged medium at a position of the second direction side further than the position with which the first contact portion is in contact, in the recording surface intersecting direction.

3. The recording apparatus according to claim 2, wherein the first contact portion and the second contact portion are provided at positions overlapping each other in the discharging direction in which the medium is discharged.

4. The recording apparatus according to claim 2, wherein the first contact portion and the second contact portion are provided at positions different from each other in the discharging direction in which the medium is discharged.

5. The recording apparatus according to claim 4, wherein the discharging portion is provided at the downstream side further than the first contact portion and the second contact portion, in the discharging direction.

6. The recording apparatus according to claim 4, wherein the discharging portion is provided at the upper stream side further than the first contact portion and the second contact portion, in the discharging direction.

7. The recording apparatus according to claim 2, wherein, in the contact position with the medium in the second contact portion, the position in the recording surface intersecting direction is capable of being displaced.

8. The recording apparatus according to claim 2, wherein the second contact portion is provided to be movable in the width direction.

9. The recording apparatus according to claim 2, wherein, in at least one of the first contact portion and the second contact portion, the contact position which is in contact with the medium at the time of being in contact with the medium, is capable of being displaced to the downstream side in the discharging direction in which the medium is discharged.

10. The recording apparatus according to claim 1, wherein the first operating portion is a first air blowing portion which blows the air to a surface in the first region of the discharged medium.

11. The recording apparatus according to claim 1, wherein the second operating portion is a second air blowing portion which blows the air to a surface in the second region of the discharged medium.

* * * * *